US006644032B1

(12) United States Patent
Jorgensen et al.

(10) Patent No.: US 6,644,032 B1
(45) Date of Patent: Nov. 11, 2003

(54) TRANSITION DUCT WITH ENHANCED PROFILE OPTIMIZATION

(75) Inventors: Stephen W. Jorgensen, Stuart, FL (US); John C. Resos, Stuart, FL (US); Zhenhua Xiao, Palm Beach Gardens, FL (US); Heather Johnston, Stuart, FL (US)

(73) Assignee: Power Systems MFG, LLC, Jupiter, FL (US)

( * ) Notice: Subject to any disclaimer, the term of this patent is extended or adjusted under 35 U.S.C. 154(b) by 0 days.

(21) Appl. No.: 10/277,659

(22) Filed: Oct. 22, 2002

(51) Int. Cl.[7] ..... F02C 1/00
(52) U.S. Cl. ..... 60/752
(58) Field of Search ..... 60/39.37, 752, 60/805

(56) References Cited

U.S. PATENT DOCUMENTS 3,657,882 A * 4/1972 Hugoson ..... 60/798
5,761,898 A * 6/1998 Barnes et al. ..... 60/799
5,983,641 A * 11/1999 Mandai et al. ..... 60/722

* cited by examiner

*Primary Examiner*—Charles G. Freay
(74) *Attorney, Agent, or Firm*—Brian R. Mack

(57) ABSTRACT

A transition duct having a panel assembly with an inlet end of generally circular cross section and an outlet end having a generally rectangular arc-like cross section is disclosed. The panel assembly has an uncoated internal profile substantially in accordance with coordinate values X, Y, and Z as set forth in Table 1 carried only to three decimal places wherein the coordinates are taken at a sweep angle θ wherein θ is an angle measured from said inlet end and X, Y, and Z are coordinates defining the panel assembly profile at each angle θ from the inlet end. An alternate embodiment is also disclosed defining an envelope for the uncoated internal profile of the panel assembly.

13 Claims, 7 Drawing Sheets

TRANSITION DUCT WITH ENHANCED PROFILE OPTIMIZATION

BACKGROUND OF THE INVENTION

1. Field of the Invention

This invention relates to a transition duct for a gas turbine engine, specifically to a novel and improved profile for a transition duct that results in lower operating stresses and extended component life.

2. Description of Related Art

In a typical can annular gas turbine engine, a plurality of combustors are arranged in an annular array about the engine. The combustors receive pressurized air from the engine's compressor, adds fuel to create a fuel/air mixture, and combusts that mixture to produce hot gases. The hot gases exiting the combustors are utilized to turn a turbine, which is coupled to a shaft that drives a generator for generating electricity.

The hot gases are transferred from the combustor to the turbine by a transition duct. Due to the position of the combustors relative to the turbine inlet, the transition duct must change cross-sectional shape from a generally cylindrical shape at the combustor exit to a generally rectangular arc-like shape at the turbine inlet. In addition, the transition duct undergoes a change in radial position, since the combustors are typically mounted outboard of the turbine. Extreme care must be taken with respect to the design of these geometric transitions to avoid sharp geometric changes, otherwise regions of high stress and stress concentrations can occur. The combination of complex geometry changes as well as extreme mechanical and thermal loading seen by the transition duct create a harsh operating environment that can lead to premature deterioration, requiring repair and replacement of the transition ducts. To withstand the hot temperatures from the combustor gases, transition ducts are typically air-cooled. A variety of methods are available to provide cooling such as through internal channels, impingement cooling, or effusion cooling. Severe cracking has been known to occur in transition ducts having extremely sharp geometry changes and internal air-cooled channels.

The present invention seeks to overcome the shortfalls of the prior art by providing a transition duct having a geometric profile optimized to eliminate areas having high stress concentrations and high steady and vibratory stresses while still transferring the hot combustion gases from the combustor to the turbine inlet in an acceptable manner.

SUMMARY AND OBJECTS OF THE INVENTION

In accordance with the present invention, there is provided a novel and improved transition duct having an enhanced profile and other characteristics for improved performance and enhanced durability. To accomplish this, the internal flowpath geometry of the transition duct has been optimized to remove areas of sharp geometric change. The sharp geometric changes in combination with high thermal and mechanical loading, caused regions of high steady and vibratory stresses and local stress concentrations can lead to cracking and premature failure of the transition duct. The internal flowpath of the transition duct has been optimized to provide a more homogeneous temperature profile of the hot combustion gases to the turbine as well as to raise the natural frequency of the transition duct. Providing a more homogeneous temperature profile to the turbine inlet helps to minimize the distress to the first stage of the turbine.

A variety of cooling methods can be used in combination with the enhanced profile of the present invention transition duct. In the preferred embodiment, the cooling system continues to use air, but the air is directed through a plurality of effusion holes in the panel assembly of the transition duct. Effusion cooling provides more uniform cooling of the transition duct than the plurality of internal cooling channels used in the prior art and were a source of stress concentrations.

In the preferred embodiment of the present invention, there is provided a transition duct with a panel assembly having an inlet end of generally circular cross section and an outlet end having a generally rectangular arc-like cross section with an uncoated internal profile substantially in accordance with the coordinate values θ, X, Y, and Z as set forth in Table 1. The origin of the coordinate system is positioned at the center of the panel assembly inlet end along a centerline axis. It will be appreciated that the coordinate values given are for manufacturing purposes, in a room temperature condition. Each set of coordinate values X, Y, and Z in Table 1 is standard Cartesian coordinates, and each set corresponds to a specific sweep angle θ, which together define a cross section of the panel assembly. Each cross section is joined smoothly with adjacent cross sections to define a panel assembly for the transition duct. It will also be appreciated that as the transition duct transfers hot combustion gases from a combustor to the turbine inlet, the transition duct heats up and therefore the coordinates provided in Table 1 do not necessarily correspond to the panel assembly position when in operation at an elevated temperature.

In an alternate preferred embodiment, there is provided a transition duct with a panel assembly having an inlet end of generally circular cross section and outlet end having a generally rectangular arc-like cross section with an uncoated internal profile within an envelope of +/−0.250 inches in a direction normal to any surface of the panel assembly substantially in accordance with the coordinate values θ, X, Y, and Z as set forth in Table 1. The origin of the Cartesian coordinate system is positioned at the center of the panel assembly inlet end along a centerline axis. A distance of +/−0.250 inches in a direction normal to any surface location along the panel assembly defines an envelope for this particular panel assembly and ensures that manufacturing tolerances are accommodated within the envelope of the panel assembly. As with the first preferred embodiment, it will be appreciated that the coordinate values given are for manufacturing purposes, in a room temperature condition. Each set of coordinate values X, Y, and Z in Table 1 is in standard Cartesian coordinates, and each set corresponds to a specific sweep angle θ, which defines a cross section of the panel assembly. Each cross section is joined smoothly with adjacent cross sections to define a panel assembly for the transition duct. It will also be appreciated that as the transition duct transfers hot combustion gases from a combustor to the turbine inlet, the transition duct heats up and therefore the Cartesian coordinates for a given θ value provided in Table 1 may not necessarily correspond to the panel assembly position when in operation at an elevated temperature.

It is an object of the present invention to provide a novel, optimized internal profile for a panel assembly of a gas turbine transition duct having improved robustness and extended life.

It is another object of the present invention to provide a novel and optimized internal profile for a panel assembly of a gas turbine transition duct having an envelope for the profile defining manufacturing tolerances.

In accordance with these and other objects, which will become apparent hereinafter, the instant invention will now be described with particular reference to the accompanying drawings.

DETAILED DESCRIPTION OF THE PREFERRED EMBODIMENT

Figure 1:
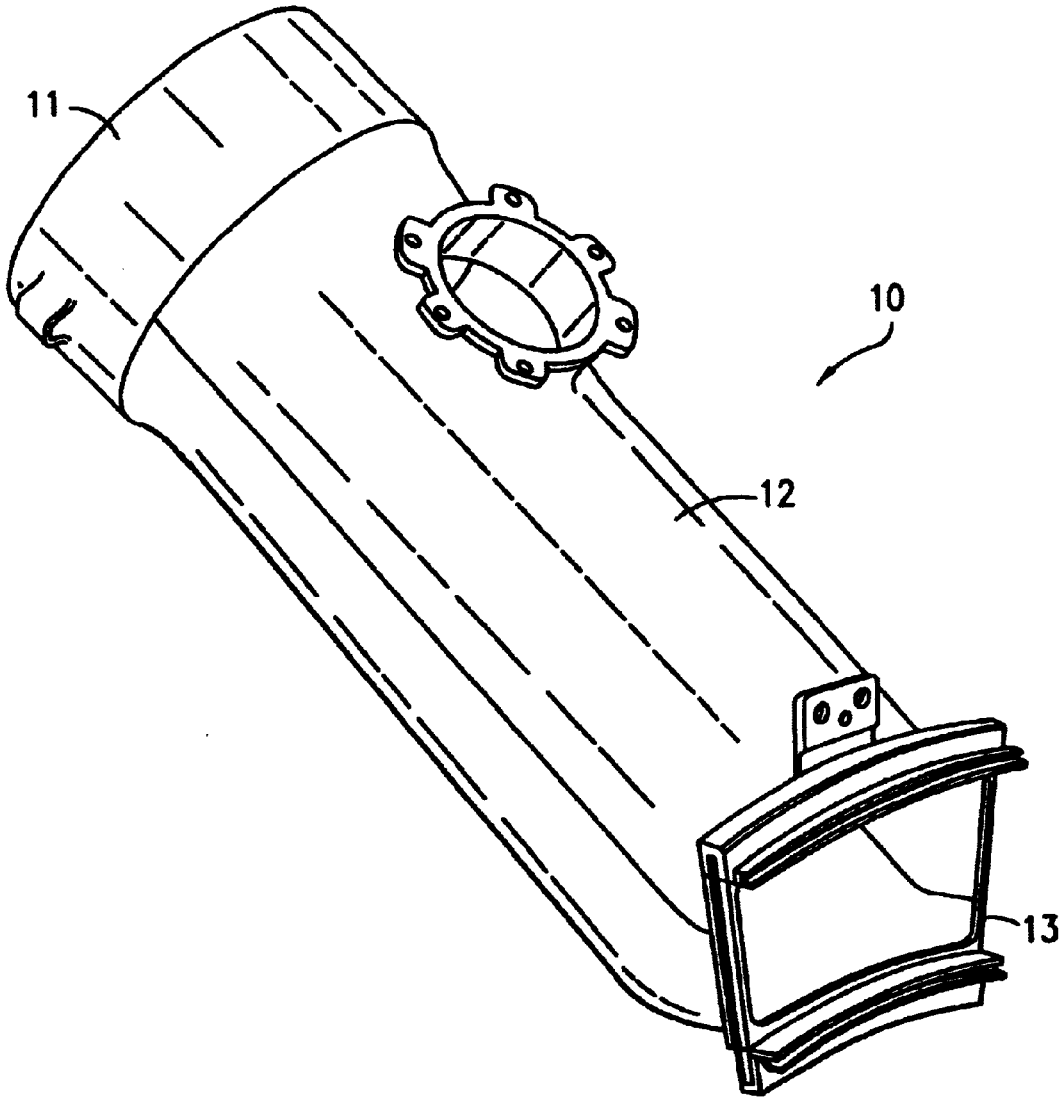
FIG. 1 PRIOR ART
FIG. 1 is a perspective view of a transition duct of the prior art.
Figure 2:
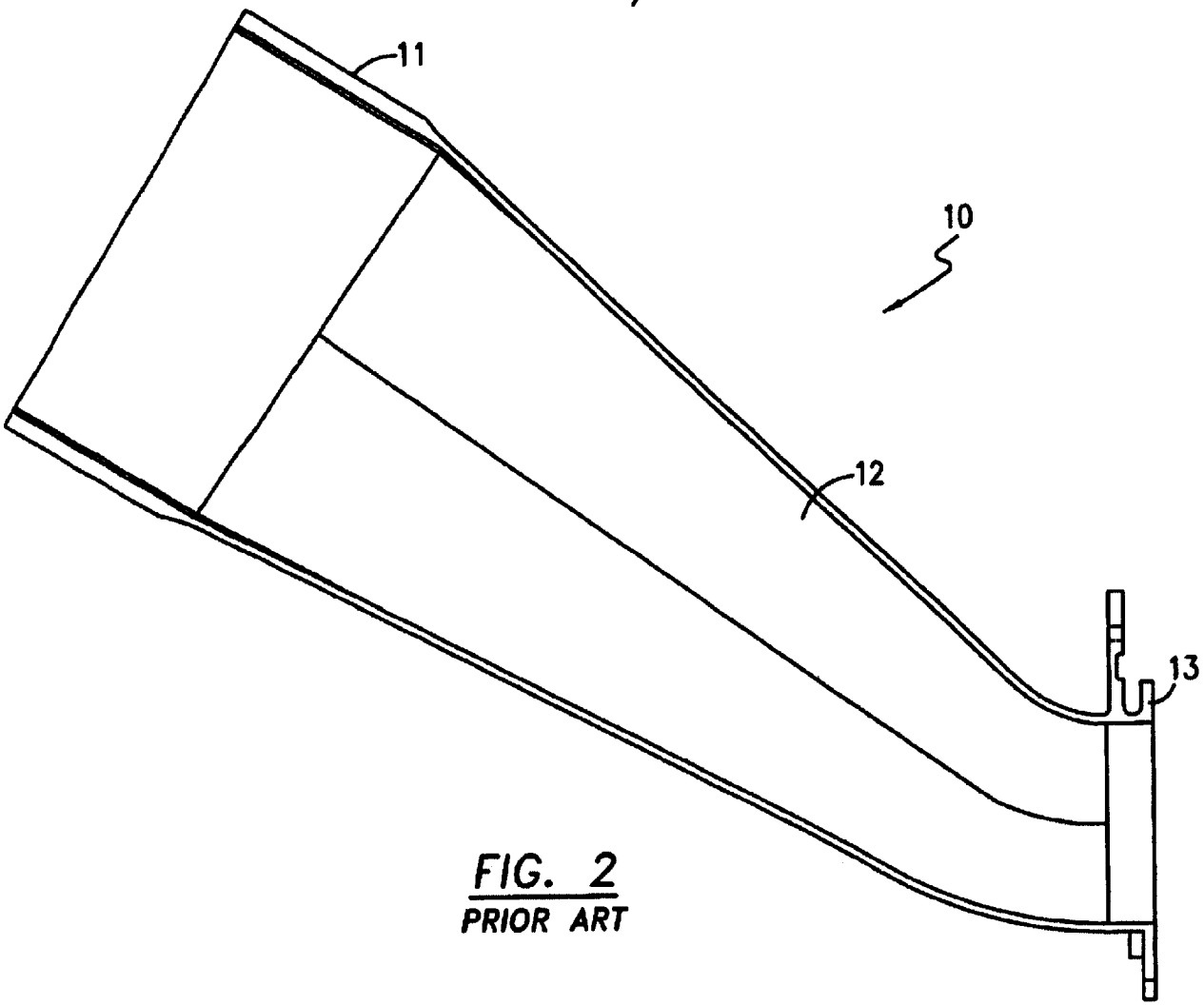
FIG. 2 PRIOR ART
FIG. 2 is a cross section view of a transition duct of the prior art.

Referring to FIGS. 1 and 2, a transition duct 10 of the prior art is shown. Transition duct 10 contains an inlet ring 11, a panel assembly 12, and an aft frame 13. Inlet ring 11 is of generally circular cross section while aft frame 13 is of generally rectangular arc-like cross section where the generally rectangular arc-like shape is defined by a pair of concentric arcs of different diameters connected by a pair of radial lines. Transition duct 10, which is used to transfer hot combustion gases from a combustor to a turbine, has geometric profile that must transition from a generally circular cross section to that of a generally arc-like cross section at the turbine inlet as well as changing radial positions. The geometric profile of transition duct 10 contains a sharp transition from circular to rectangular arc-like over a short axial and radial distance thereby resulting in high stress regions throughout the aft end of transition duct 10.

Figure 3:
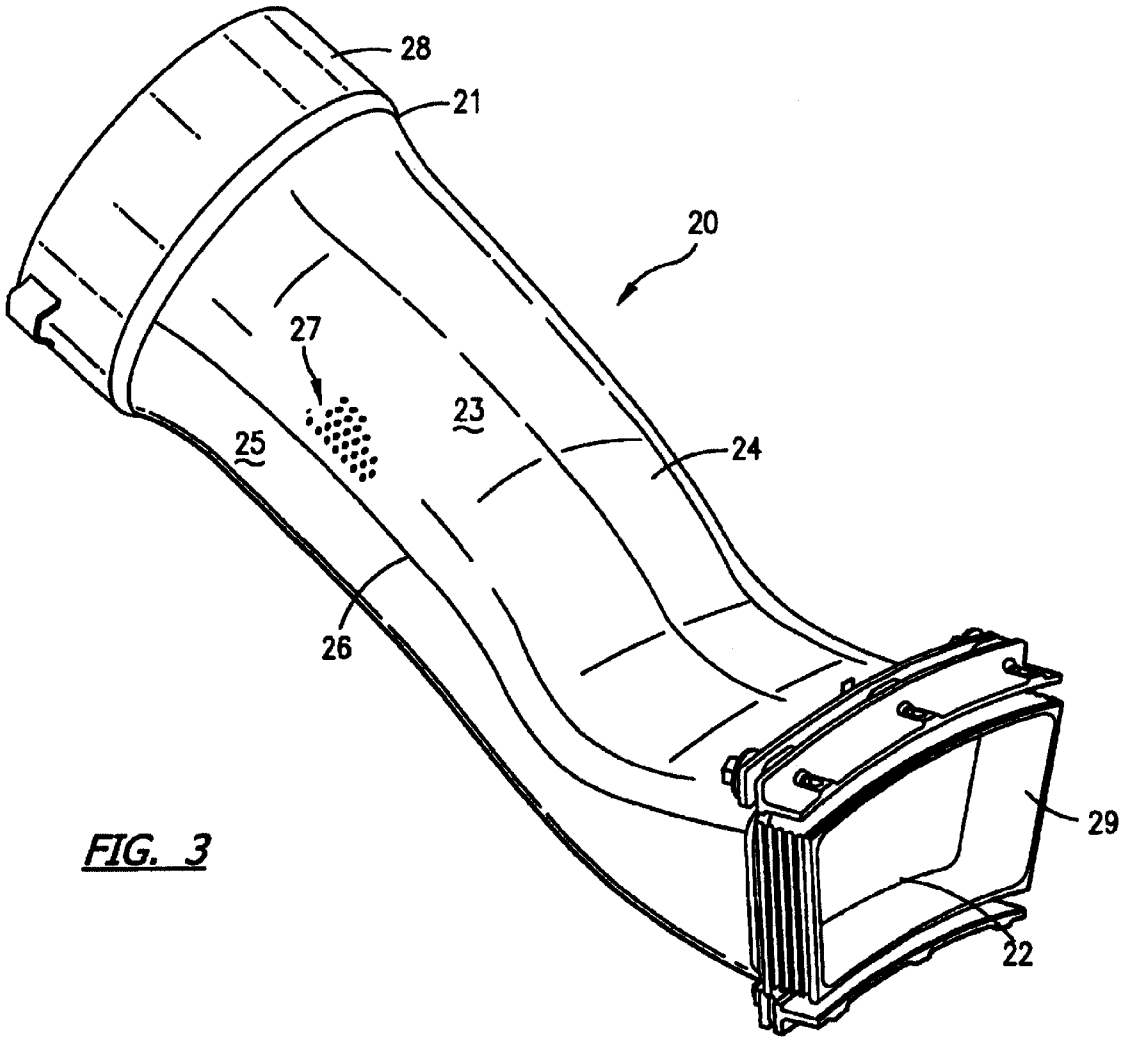
FIG. 3 is a perspective view of the preferred embodiment of the present invention.
Figure 4:
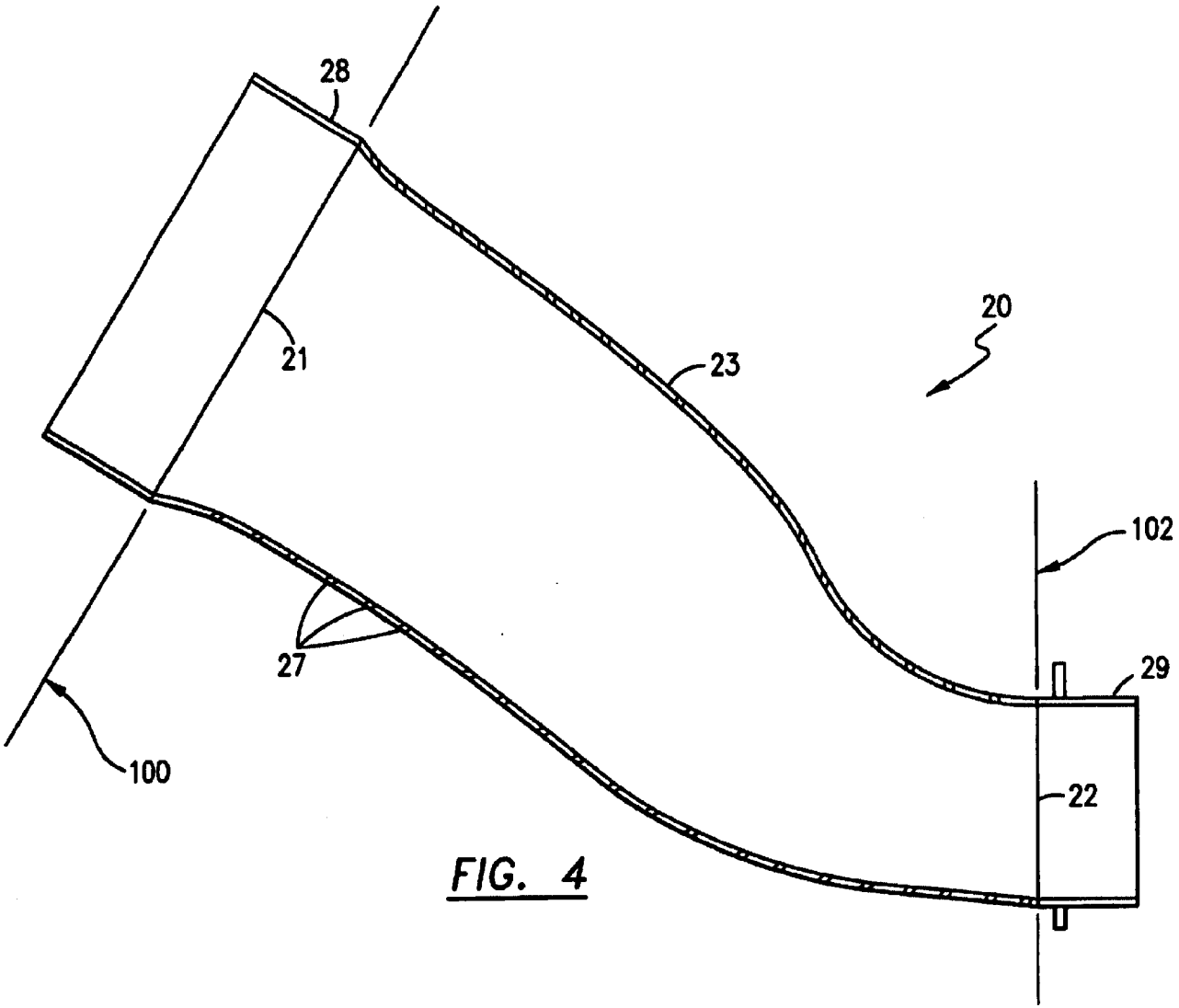
FIG. 4 is a cross section view of the preferred embodiment of the present invention.

The present invention is shown in FIGS. 3–7. Referring to FIGS. 3 and 4, transition duct 20 includes a panel assembly 23 having an inlet end 21 of generally circular cross section and an outlet end 22 having a generally rectangular arc-like cross section. Panel assembly 23 comprises an upper panel 24 and lower panel 25 joined together along a plurality of axial seams 26 by a means such as welding. Panel assembly 23 also contains a plurality of cooling holes 27 extending throughout upper panel 24 and lower panel 25 to provide cooling air to said panels. Transition duct 20 further includes an inlet ring 28 fixed to inlet end 21 and an aft frame 29 fixed to outlet end 22. Panel assembly 23 of transition duct 20 is preferably manufactured from a high temperature nickel base alloy such as Haynes 230.

Figure 5:
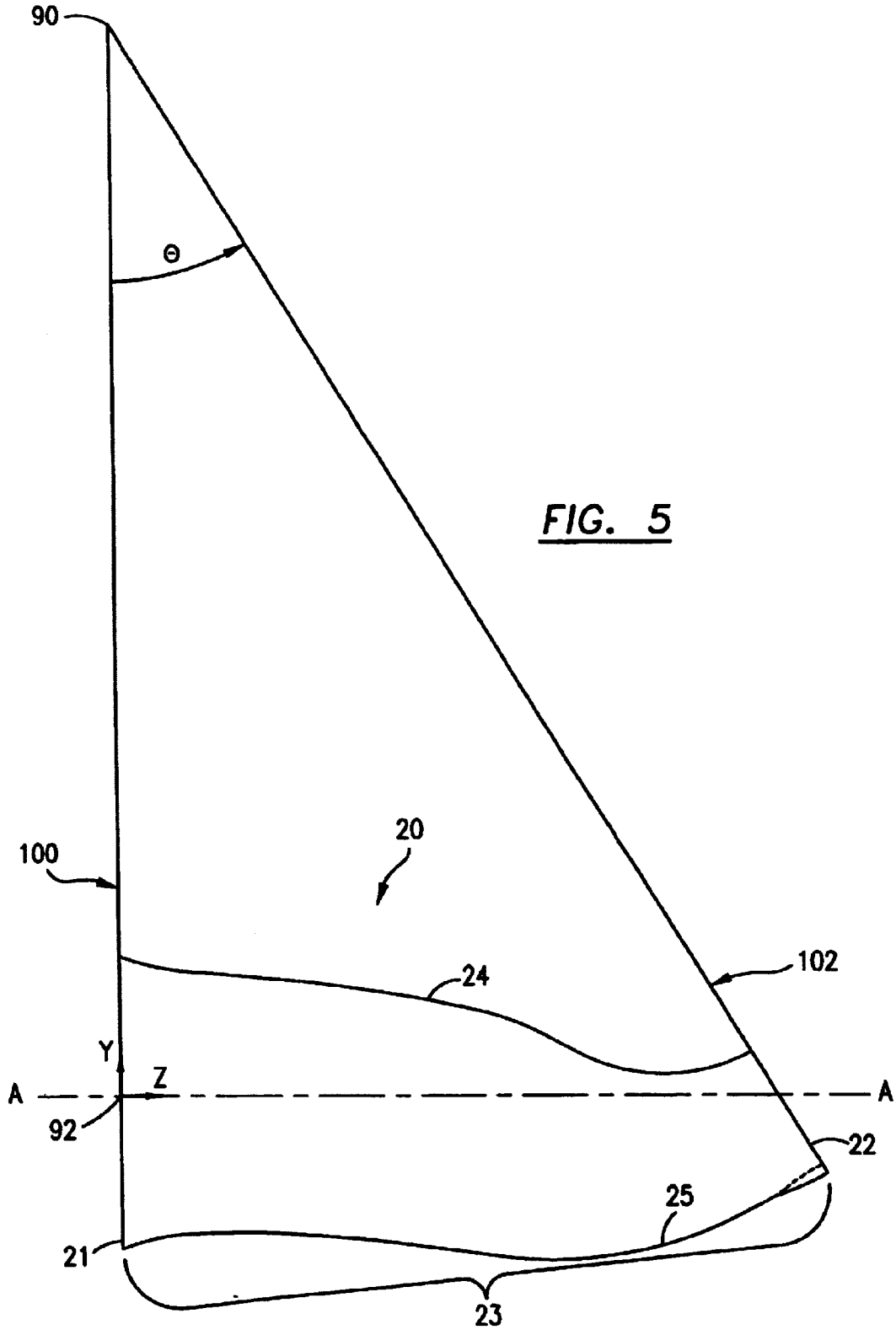
FIG. 5 is a cross section view of the preferred embodiment of the panel assembly of present invention.

Panel assembly 23, formed from upper panel 24 and lower panel 25, has an uncoated internal profile substantially in accordance with coordinate values X, Y, and Z as set forth in Table 1, carried only to three decimal places. Although the preferred unit of measure for the values given in Table 1 is inches, those skilled in the art will appreciate that the values of Table 1 for X, Y, and Z can be scaled up or down depending on the diameter of the particular combustion liner with which the present invention is to be used. This uncoated internal profile provides an optimized transition from a generally circular inlet end to a generally rectangular arc-like outlet end over the allowable axial and radial distance for a gas turbine engine, such that high steady stresses and stress concentrations in transition duct 20 are minimized. For the purpose of describing the present invention, the coordinate values X, Y, and Z of Table 1 are taken at various sweep angles θ wherein θ is an angle measured from inlet end 21 and increases to its maximum value at outlet end 22. Sweep angle θ originates at the intersection line 90 of two planes, a first plane 100 that is defined by inlet end 21 of panel assembly 23 and a second plane 102 that is defined by outlet end 22 of panel assembly 23, as shown in FIGS. 4 and 5. The origin 92 of the Cartesian coordinate system, from which data in Table 1 is generated, is positioned at center of inlet end 21 of transition duct 20 along an axis A—A that runs through the center of inlet end 21, and is perpendicular to plane 100, at inlet end 21. The Cartesian coordinate system is oriented such that X and Y extend radially out from origin 92, or center point of inlet end 21, and Z extends axially along axis A—A towards outlet end 22, as shown in FIG. 5. Coordinate values X, Y, and Z are listed in Table 1 for each sweep angle θ, measured in one degree increments, necessary to define the optimized internal profile of panel assembly 23. The data compiled in Table 1 is computer generated and though it represents the nominal uncoated internal profile, the data will vary depending on manufacturing tolerances. Therefore, it will be appreciated that a gas turbine component of this size having a panel assembly 23 fabricated primarily from formed and welded sheet metal can be expected to have manufacturing tolerances of at least +/−0.062 inches.

Figure 6A:
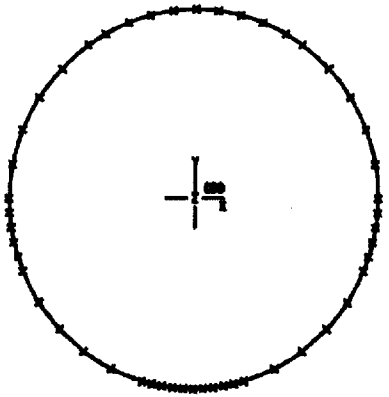
FIGS. 6*a*, 6*b*, 6*c*, and 6*d* are section views taken through the panel assembly of the present invention at various sweep angles.
Figure 6B:
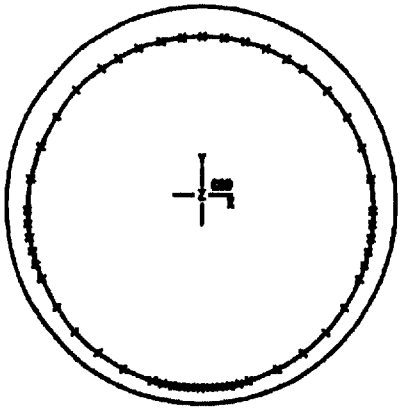
Figure 6C:
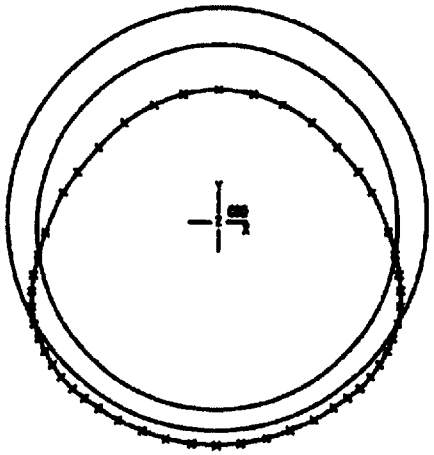
Figure 6D:
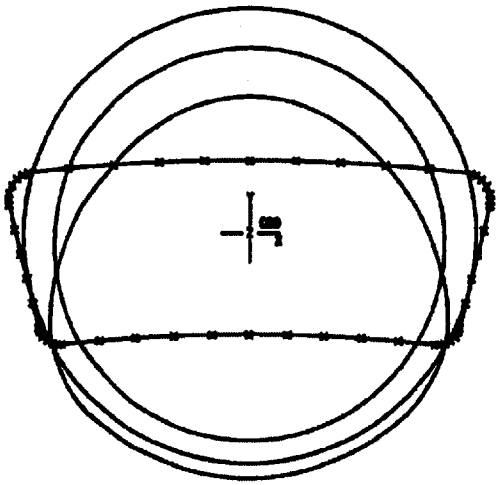
Figure 7:
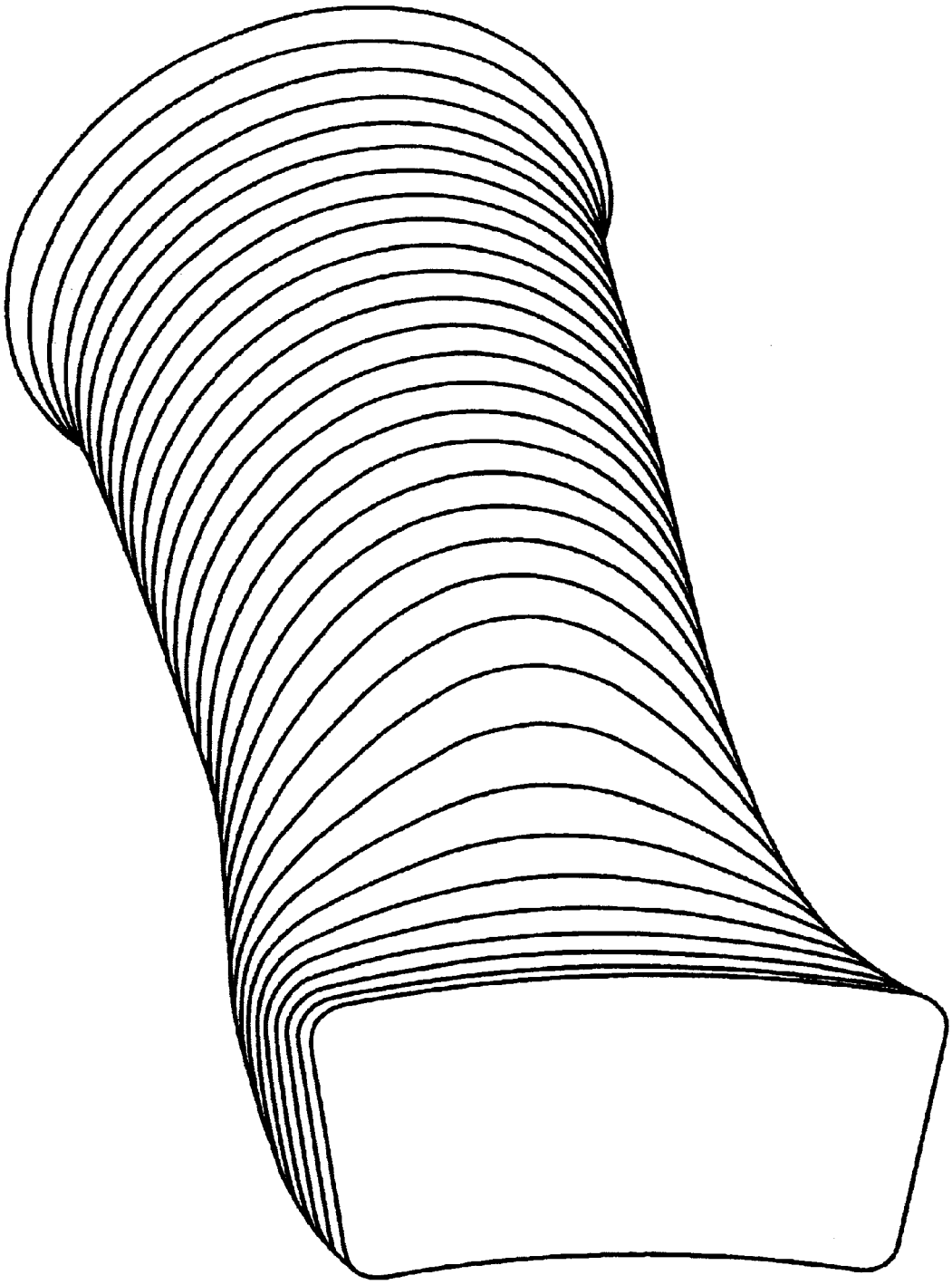
FIG. 7 is a perspective view showing each of the cross sections used to define the panel assembly of the present invention.

For the data listed in Table 1 a plurality of wireframe sections can be created when applying a best-fit curve to the section data for each sweep angle θ. For example, FIGS. 6*a*–6*d* show wireframe cross sections taken at various sweep angles from inlet end 21 to outlet end 22 of panel assembly 23 as well as the Cartesian coordinates (each shown as an "x" in FIGS. 6*a*–6*d*) used to define each section taken. In FIGS. 6*a*–6*d*, for clarity, the wireframe sections are shown progressively stacked to show the change from the previous section(s). In each of FIGS. 6*a*–6*d*, the relevant section is the one with multiple "x" markings; the other sections shown are merely for reference purposes. At inlet end 21, a section is taken corresponding to θ=0.0 degrees and is shown in section view in FIG. 6*a*, while FIG. 6*b* shows a section taken where the sweep angle θ=10.0 degrees. In FIG. 6*c*, where a section is taken with θ=20.0 degrees, panel assembly 23 is shown transitioning from a generally circular cross section to a rectangular arc-like shape. A final section demonstrating this transition is shown in FIG. 6*d* and taken at θ=31.0 degrees, at the outlet end 22 of panel assembly 23. It can be seen in FIGS. 6*a*–6*d* how the section geometry of panel assembly 23 transitions from a generally circular cross section to a generally rectangular arc-like cross section. FIG. 7 shows, in perspective view, each wireframe section formed at each respective sweep angle θ, that when compiled, define the internal flowpath of panel assembly 23 of transition duct 20.

An additional feature of transition duct 20 is a protective two-layer coating applied along the internal profile of panel assembly 23 to protect transition duct 20 from deterioration associated with prolonged exposure to elevated temperatures. The two-layer air plasma sprayed coating preferably comprises a MCrAlY bond coating applied directly to panel assembly 23 and a Yttra Stabilized Zirconia top coating applied over the bond coating, the combined coating having a thickness of at least 0.019 inches. The two-layer coating is preferably applied once panel assembly 23 has been formed and welded in accordance with the profile as defined in Table 1.

In an alternate embodiment of the present invention there is provided a transition duct identical to that of the preferred embodiment except for the uncoated internal profile of panel assembly 23 is within an envelope of +/−0.250 inches in a direction normal to any surface of the panel assembly substantially in accordance with the Cartesian coordinate values X, Y, and Z as set forth in Table 1. A distance of +/−0.250 inches in a direction normal to any surface of the panel assembly thereby defines a profile envelope for this specific transition duct panel assembly. This envelope ensures that all reasonable manufacturing tolerances are accommodated within the profile.

The X, Y, Z Cartesian coordinate data and corresponding sweep angles θ are summarized in the following Table 1.

TABLE 1

| Theta (deg.) | X | Y | Z |
|---|---|---|---|
| 0.0 | 0.000 | 6.880 | 0.000 |
| 0.0 | 0.839 | 6.829 | 0.000 |
| 0.0 | 1.666 | 6.675 | 0.000 |
| 0.0 | 2.468 | 6.422 | 0.000 |
| 0.0 | 3.234 | 6.073 | 0.000 |
| 0.0 | 3.950 | 5.633 | 0.000 |
| 0.0 | 4.952 | 4.776 | 0.000 |
| 0.0 | 5.772 | 3.745 | 0.000 |
| 0.0 | 6.380 | 2.575 | 0.000 |
| 0.0 | 6.754 | 1.312 | 0.000 |
| 0.0 | 6.880 | 0.000 | 0.000 |
| 0.0 | 6.859 | −0.537 | 0.000 |
| 0.0 | 6.796 | −1.071 | 0.000 |
| 0.0 | 6.692 | −1.598 | 0.000 |
| 0.0 | 6.547 | −2.116 | 0.000 |
| 0.0 | 6.361 | −2.620 | 0.000 |
| 0.0 | 5.800 | −3.700 | 0.000 |
| 0.0 | 5.058 | −4.664 | 0.000 |
| 0.0 | 4.157 | −5.482 | 0.000 |
| 0.0 | 3.127 | −6.129 | 0.000 |
| 0.0 | 1.998 | −6.583 | 0.000 |
| 0.0 | 1.607 | −6.690 | 0.000 |
| 0.0 | 1.210 | −6.773 | 0.000 |
| 0.0 | 0.809 | −6.832 | 0.000 |
| 0.0 | 0.405 | −6.868 | 0.000 |
| 0.0 | 0.000 | −6.880 | 0.000 |
| 0.0 | −0.405 | −6.868 | 0.000 |
| 0.0 | −0.809 | −6.832 | 0.000 |
| 0.0 | −1.210 | −6.773 | 0.000 |
| 0.0 | −1.607 | −6.690 | 0.000 |
| 0.0 | −1.998 | −6.583 | 0.000 |
| 0.0 | −3.127 | −6.129 | 0.000 |
| 0.0 | 4.157 | −5.482 | 0.000 |
| 0.0 | −5.058 | −4.664 | 0.000 |
| 0.0 | −5.800 | −3.700 | 0.000 |
| 0.0 | −6.361 | −2.620 | 0.000 |
| 0.0 | −6.547 | −2.116 | 0.000 |
| 0.0 | −6.692 | −1.598 | 0.000 |
| 0.0 | −6.796 | −1.071 | 0.000 |
| 0.0 | −6.859 | −0.537 | 0.000 |
| 0.0 | −6.880 | 0.000 | 0.000 |
| 0.0 | −6.754 | 1.312 | 0.000 |
| 0.0 | −6.380 | 2.575 | 0.000 |
| 0.0 | −5.772 | 3.745 | 0.000 |
| 0.0 | −4.952 | 4.776 | 0.000 |
| 0.0 | −3.234 | 6.073 | 0.000 |
| 0.0 | −2.468 | 6.422 | 0.000 |
| 0.0 | −1.666 | 6.675 | 0.000 |
| 0.0 | −0.839 | 6.829 | 0.000 |
| 1.0 | 0.000 | 6.607 | 0.778 |

TABLE 1-continued

| Theta (deg.) | X | Y | Z |
|---|---|---|---|
| 1.0 | 0.808 | 6.557 | 0.779 |
| 1.0 | 1.604 | 6.407 | 0.782 |
| 1.0 | 2.376 | 6.161 | 0.786 |
| 1.0 | 3.112 | 5.823 | 0.792 |
| 1.0 | 3.801 | 5.398 | 0.800 |
| 1.0 | 4.760 | 4.571 | 0.814 |
| 1.0 | 5.541 | 3.576 | 0.831 |
| 1.0 | 6.116 | 2.448 | 0.851 |
| 1.0 | 6.465 | 1.231 | 0.872 |
| 1.0 | 6.573 | −0.030 | 0.894 |
| 1.0 | 6.548 | −0.537 | 0.903 |
| 1.0 | 6.485 | −1.042 | 0.912 |
| 1.0 | 6.383 | −1.540 | 0.921 |
| 1.0 | 6.242 | −2.028 | 0.929 |
| 1.0 | 6.064 | −2.504 | 0.938 |
| 1.0 | 5.530 | −3.526 | 0.955 |
| 1.0 | 4.824 | −4.439 | 0.971 |
| 1.0 | 3.970 | −5.214 | 0.985 |
| 1.0 | 2.993 | −5.827 | 0.996 |
| 1.0 | 1.923 | −6.258 | 1.003 |
| 1.0 | 1.546 | −6.359 | 1.005 |
| 1.0 | 1.165 | −6.439 | 1.006 |
| 1.0 | 0.779 | −6.497 | 1.007 |
| 1.0 | 0.390 | −6.532 | 1.008 |
| 1.0 | 0.000 | −6.543 | 1.008 |
| 1.0 | −0.390 | −6.532 | 1.008 |
| 1.0 | −0.779 | −6.497 | 1.007 |
| 1.0 | −1.165 | −6.439 | 1.006 |
| 1.0 | −1.546 | −6.359 | 1.005 |
| 1.0 | −1.923 | −6.258 | 1.003 |
| 1.0 | −2.993 | −5.827 | 0.996 |
| 1.0 | −3.970 | −5.214 | 0.985 |
| 1.0 | −4.824 | −4.439 | 0.971 |
| 1.0 | −5.530 | −3.526 | 0.955 |
| 1.0 | −6.064 | −2.504 | 0.938 |
| 1.0 | −6.242 | −2.028 | 0.929 |
| 1.0 | −6.383 | −1.540 | 0.921 |
| 1.0 | −6.485 | −1.042 | 0.912 |
| 1.0 | −6.548 | −0.537 | 0.903 |
| 1.0 | −6.573 | −0.030 | 0.894 |
| 1.0 | −6.465 | 1.231 | 0.872 |
| 1.0 | −6.116 | 2.448 | 0.851 |
| 1.0 | −4.760 | 4.571 | 0.814 |
| 1.0 | −3.801 | 5.398 | 0.800 |
| 1.0 | −3.112 | 5.823 | 0.792 |
| 1.0 | −2.376 | 6.161 | 0.786 |
| 1.0 | −1.604 | 6.407 | 0.782 |
| 1.0 | −0.808 | 6.557 | 0.779 |
| 2.0 | 0.000 | 6.394 | 1.565 |
| 2.0 | 0.786 | 6.344 | 1.567 |
| 2.0 | 1.560 | 6.196 | 1.572 |
| 2.0 | 2.310 | 5.955 | 1.580 |
| 2.0 | 3.026 | 5.624 | 1.592 |
| 2.0 | 3.696 | 5.211 | 1.606 |
| 2.0 | 4.618 | 4.413 | 1.634 |
| 2.0 | 5.367 | 3.452 | 1.668 |
| 2.0 | 5.918 | 2.364 | 1.706 |
| 2.0 | 6.249 | 1.191 | 1.747 |
| 2.0 | 6.351 | −0.024 | 1.789 |
| 2.0 | 6.326 | −0.517 | 1.806 |
| 2.0 | 6.264 | −1.007 | 1.823 |
| 2.0 | 6.164 | −1.490 | 1.840 |
| 2.0 | 6.027 | −1.964 | 1.857 |
| 2.0 | 5.854 | −2.427 | 1.873 |
| 2.0 | 5.341 | −3.407 | 1.907 |
| 2.0 | 4.666 | −4.284 | 1.938 |
| 2.0 | 3.849 | −5.030 | 1.964 |
| 2.0 | 2.913 | −5.621 | 1.984 |
| 2.0 | 1.887 | −6.036 | 1.999 |
| 2.0 | 1.517 | −6.135 | 2.002 |
| 2.0 | 1.143 | −6.214 | 2.005 |
| 2.0 | 0.764 | −6.272 | 2.007 |
| 2.0 | 0.383 | −6.306 | 2.008 |
| 2.0 | 0.000 | −6.317 | 2.009 |
| 2.0 | −0.383 | −6.306 | 2.008 |
| 2.0 | −0.764 | −6.272 | 2.007 |
| 2.0 | −1.143 | −6.214 | 2.005 |

TABLE 1-continued

| Theta (deg.) | X | Y | Z |
|---|---|---|---|
| 2.0 | −1.517 | −6.135 | 2.002 |
| 2.0 | −1.887 | −6.036 | 1.999 |
| 2.0 | −2.913 | −5.621 | 1.984 |
| 2.0 | −3.849 | −5.030 | 1.964 |
| 2.0 | −4.666 | −4.284 | 1.938 |
| 2.0 | −5.341 | −3.407 | 1.907 |
| 2.0 | −5.854 | −2.427 | 1.873 |
| 2.0 | −6.027 | −1.964 | 1.857 |
| 2.0 | −6.164 | −1.490 | 1.840 |
| 2.0 | −6.264 | −1.007 | 1.823 |
| 2.0 | −6.326 | −0.517 | 1.806 |
| 2.0 | −6.351 | −0.024 | 1.789 |
| 2.0 | −5.918 | 2.364 | 1.706 |
| 2.0 | −5.367 | 3.452 | 1.668 |
| 2.0 | −4.618 | 4.413 | 1.634 |
| 2.0 | −3.696 | 5.211 | 1.606 |
| 2.0 | −3.026 | 5.625 | 1.592 |
| 2.0 | −2.310 | 5.955 | 1.580 |
| 2.0 | −1.560 | 6.196 | 1.572 |
| 2.0 | −0.786 | 6.344 | 1.567 |
| 3.0 | 0.000 | 6.248 | 2.356 |
| 3.0 | 0.773 | 6.198 | 2.359 |
| 3.0 | 1.532 | 6.051 | 2.367 |
| 3.0 | 2.269 | 5.811 | 2.379 |
| 3.0 | 2.971 | 5.487 | 2.396 |
| 3.0 | 3.631 | 5.082 | 2.417 |
| 3.0 | 4.529 | 4.304 | 2.458 |
| 3.0 | 5.258 | 3.367 | 2.507 |
| 3.0 | 5.792 | 2.307 | 2.563 |
| 3.0 | 6.115 | 1.164 | 2.623 |
| 3.0 | 6.213 | −0.019 | 2.685 |
| 3.0 | 6.190 | −0.504 | 2.710 |
| 3.0 | 6.131 | −0.986 | 2.735 |
| 3.0 | 6.033 | −1.462 | 2.760 |
| 3.0 | 5.898 | −1.929 | 2.785 |
| 3.0 | 5.728 | −2.384 | 2.809 |
| 3.0 | 5.233 | −3.340 | 2.859 |
| 3.0 | 4.580 | −4.197 | 2.904 |
| 3.0 | 3.787 | −4.927 | 2.942 |
| 3.0 | 2.878 | −5.507 | 2.972 |
| 3.0 | 1.880 | −5.914 | 2.994 |
| 3.0 | 1.512 | −6.012 | 2.999 |
| 3.0 | 1.138 | −6.092 | 3.003 |
| 3.0 | 0.761 | −6.150 | 3.006 |
| 3.0 | 0.381 | −6.185 | 3.008 |
| 3.0 | 0.000 | −6.196 | 3.008 |
| 3.0 | −0.381 | −6.185 | 3.008 |
| 3.0 | −0.761 | −6.150 | 3.006 |
| 3.0 | −1.138 | −6.092 | 3.003 |
| 3.0 | −1.512 | −6.012 | 2.999 |
| 3.0 | −1.880 | −5.914 | 2.994 |
| 3.0 | −2.878 | −5.507 | 2.972 |
| 3.0 | −3.787 | −4.927 | 2.942 |
| 3.0 | −4.580 | −4.197 | 2.904 |
| 3.0 | −5.233 | −3.340 | 2.859 |
| 3.0 | −5.728 | −2.384 | 2.809 |
| 3.0 | −5.898 | −1.929 | 2.785 |
| 3.0 | −6.033 | −1.462 | 2.760 |
| 3.0 | −6.131 | −0.986 | 2.735 |
| 3.0 | −6.213 | −0.019 | 2.685 |
| 3.0 | −6.115 | 1.164 | 2.623 |
| 3.0 | −5.792 | 2.307 | 2.563 |
| 3.0 | −5.258 | 3.367 | 2.507 |
| 3.0 | −4.529 | 4.304 | 2.458 |
| 3.0 | −3.631 | 5.082 | 2.417 |
| 3.0 | −2.971 | 5.487 | 2.396 |
| 3.0 | −2.269 | 5.811 | 2.379 |
| 3.0 | −1.532 | 6.051 | 2.367 |
| 3.0 | −0.773 | 6.198 | 2.359 |
| 4.0 | 0.000 | 6.166 | 3.150 |
| 4.0 | 0.767 | 6.116 | 3.153 |
| 4.0 | 1.521 | 5.968 | 3.163 |
| 4.0 | 2.251 | 5.730 | 3.180 |
| 4.0 | 2.949 | 5.408 | 3.203 |
| 4.0 | 3.604 | 5.008 | 3.230 |
| 4.0 | 4.491 | 4.243 | 3.284 |
| 4.0 | 5.210 | 3.318 | 3.349 |

TABLE 1-continued

| Theta (deg.) | X | Y | Z |
|---|---|---|---|
| 4.0 | 5.738 | 2.273 | 3.422 |
| 4.0 | 6.057 | 1.146 | 3.501 |
| 4.0 | 6.156 | −0.020 | 3.582 |
| 4.0 | 6.134 | −0.503 | 3.616 |
| 4.0 | 6.077 | −0.984 | 3.649 |
| 4.0 | 5.981 | −1.458 | 3.683 |
| 4.0 | 5.847 | −1.923 | 3.715 |
| 4.0 | 5.679 | −2.377 | 3.747 |
| 4.0 | 5.193 | −3.324 | 3.813 |
| 4.0 | 4.551 | −4.174 | 3.873 |
| 4.0 | 3.771 | −4.900 | 3.923 |
| 4.0 | 2.875 | −5.478 | 3.964 |
| 4.0 | 1.888 | −5.882 | 3.992 |
| 4.0 | 1.518 | −5.980 | 3.999 |
| 4.0 | 1.143 | −6.060 | 4.004 |
| 4.0 | 0.765 | −6.120 | 4.009 |
| 4.0 | 0.383 | −6.155 | 4.011 |
| 4.0 | 0.000 | −6.165 | 4.012 |
| 4.0 | −0.383 | −6.155 | 4.011 |
| 4.0 | −0.765 | −6.120 | 4.009 |
| 4.0 | −1.143 | −6.060 | 4.004 |
| 4.0 | −1.518 | −5.980 | 3.999 |
| 4.0 | −1.888 | −5.882 | 3.992 |
| 4.0 | −2.875 | −5.478 | 3.964 |
| 4.0 | −3.771 | −4.900 | 3.923 |
| 4.0 | −4.551 | −4.174 | 3.873 |
| 4.0 | −5.193 | −3.324 | 3.813 |
| 4.0 | −5.679 | −2.377 | 3.747 |
| 4.0 | −5.847 | −1.923 | 3.715 |
| 4.0 | −6.077 | −0.984 | 3.649 |
| 4.0 | −6.134 | −0.503 | 3.616 |
| 4.0 | −6.156 | −0.020 | 3.582 |
| 4.0 | −6.057 | 1.146 | 3.501 |
| 4.0 | −5.738 | 2.273 | 3.422 |
| 4.0 | −5.210 | 3.318 | 3.349 |
| 4.0 | −4.491 | 4.243 | 3.284 |
| 4.0 | −3.604 | 5.008 | 3.230 |
| 4.0 | −2.949 | 5.408 | 3.203 |
| 4.0 | −2.251 | 5.730 | 3.180 |
| 4.0 | −1.521 | 5.968 | 3.163 |
| 4.0 | −0.767 | 6.116 | 3.153 |
| 5.0 | 0.000 | 6.121 | 3.944 |
| 5.0 | 0.773 | 6.069 | 3.949 |
| 5.0 | 1.532 | 5.917 | 3.962 |
| 5.0 | 2.267 | 5.673 | 3.984 |
| 5.0 | 2.968 | 5.346 | 4.012 |
| 5.0 | 3.627 | 4.940 | 4.048 |
| 5.0 | 4.499 | 4.177 | 4.114 |
| 5.0 | 5.203 | 3.258 | 4.195 |
| 5.0 | 5.718 | 2.222 | 4.286 |
| 5.0 | 6.027 | 1.107 | 4.383 |
| 5.0 | 6.121 | −0.045 | 4.484 |
| 5.0 | 6.099 | −0.527 | 4.526 |
| 5.0 | 6.042 | −1.005 | 4.568 |
| 5.0 | 5.946 | −1.477 | 4.609 |
| 5.0 | 5.812 | −1.940 | 4.650 |
| 5.0 | 5.645 | −2.392 | 4.689 |
| 5.0 | 5.165 | −3.329 | 4.771 |
| 5.0 | 4.531 | −4.171 | 4.845 |
| 5.0 | 3.761 | −4.892 | 4.908 |
| 5.0 | 2.876 | −5.466 | 4.958 |
| 5.0 | 1.901 | −5.871 | 4.994 |
| 5.0 | 1.529 | −5.971 | 5.002 |
| 5.0 | 1.152 | −6.054 | 5.010 |
| 5.0 | 0.770 | −6.114 | 5.015 |
| 5.0 | 0.386 | −6.150 | 5.018 |
| 5.0 | 0.000 | −6.161 | 5.019 |
| 5.0 | −0.386 | −6.150 | 5.018 |
| 5.0 | −0.770 | −6.114 | 5.015 |
| 5.0 | −1.152 | −6.054 | 5.010 |
| 5.0 | −1.529 | −5.971 | 5.002 |
| 5.0 | −1.901 | −5.871 | 4.994 |
| 5.0 | −2.876 | −5.466 | 4.958 |
| 5.0 | −3.761 | −4.892 | 4.908 |
| 5.0 | −4.531 | −4.171 | 4.845 |
| 5.0 | −5.165 | −3.329 | 4.771 |
| 5.0 | −5.812 | −1.940 | 4.650 |

TABLE 1-continued

| Theta (deg.) | X | Y | Z |
|---|---|---|---|
| 5.0 | −5.946 | −1.477 | 4.609 |
| 5.0 | −6.042 | −1.005 | 4.568 |
| 5.0 | −6.099 | −0.527 | 4.526 |
| 5.0 | −6.121 | −0.045 | 4.484 |
| 5.0 | −6.027 | 1.107 | 4.383 |
| 5.0 | −5.718 | 2.222 | 4.286 |
| 5.0 | −5.203 | 3.258 | 4.195 |
| 5.0 | −4.499 | 4.178 | 4.114 |
| 5.0 | −3.627 | 4.940 | 4.048 |
| 5.0 | −2.968 | 5.346 | 4.012 |
| 5.0 | −2.267 | 5.673 | 3.984 |
| 5.0 | −1.532 | 5.917 | 3.962 |
| 5.0 | −0.773 | 6.069 | 3.949 |
| 6.0 | 0.000 | 6.069 | 4.744 |
| 6.0 | 0.780 | 6.015 | 4.750 |
| 6.0 | 1.547 | 5.859 | 4.766 |
| 6.0 | 2.288 | 5.609 | 4.793 |
| 6.0 | 2.994 | 5.273 | 4.828 |
| 6.0 | 3.655 | 4.857 | 4.871 |
| 6.0 | 4.508 | 4.096 | 4.951 |
| 6.0 | 5.195 | 3.183 | 5.047 |
| 6.0 | 5.696 | 2.157 | 5.155 |
| 6.0 | 5.996 | 1.056 | 5.271 |
| 6.0 | 6.087 | −0.081 | 5.391 |
| 6.0 | 6.064 | −0.560 | 5.441 |
| 6.0 | 6.006 | −1.037 | 5.491 |
| 6.0 | 5.911 | −1.507 | 5.540 |
| 6.0 | 5.778 | −1.968 | 5.589 |
| 6.0 | 5.610 | −2.419 | 5.636 |
| 6.0 | 5.138 | −3.342 | 5.733 |
| 6.0 | 4.515 | −4.172 | 5.820 |
| 6.0 | 3.759 | −4.884 | 5.895 |
| 6.0 | 2.891 | −5.456 | 5.955 |
| 6.0 | 1.934 | −5.864 | 5.998 |
| 6.0 | 1.556 | −5.971 | 6.010 |
| 6.0 | 1.172 | −6.057 | 6.019 |
| 6.0 | 0.784 | −6.121 | 6.025 |
| 6.0 | 0.393 | −6.158 | 6.029 |
| 6.0 | 0.000 | −6.170 | 6.030 |
| 6.0 | −0.393 | −6.158 | 6.029 |
| 6.0 | −0.784 | −6.121 | 6.025 |
| 6.0 | −1.172 | −6.057 | 6.019 |
| 6.0 | −1.556 | −5.971 | 6.010 |
| 6.0 | −1.934 | −5.864 | 5.998 |
| 6.0 | −2.891 | −5.456 | 5.955 |
| 6.0 | −3.759 | −4.884 | 5.895 |
| 6.0 | −5.138 | −3.342 | 5.733 |
| 6.0 | −5.610 | −2.419 | 5.636 |
| 6.0 | −5.778 | −1.968 | 5.589 |
| 6.0 | −5.911 | −1.507 | 5.540 |
| 6.0 | −6.006 | −1.037 | 5.491 |
| 6.0 | −6.064 | −0.560 | 5.441 |
| 6.0 | −6.087 | −0.081 | 5.391 |
| 6.0 | −5.996 | 1.056 | 5.271 |
| 6.0 | −5.696 | 2.157 | 5.155 |
| 6.0 | −5.195 | 3.183 | 5.047 |
| 6.0 | −4.508 | 4.096 | 4.951 |
| 6.0 | −3.655 | 4.857 | 4.871 |
| 6.0 | −2.994 | 5.273 | 4.828 |
| 6.0 | −2.288 | 5.609 | 4.793 |
| 6.0 | −1.547 | 5.859 | 4.766 |
| 6.0 | −0.780 | 6.015 | 4.750 |
| 7.0 | 0.000 | 6.009 | 5.550 |
| 7.0 | 0.790 | 5.954 | 5.556 |
| 7.0 | 1.565 | 5.793 | 5.576 |
| 7.0 | 2.313 | 5.535 | 5.608 |
| 7.0 | 3.024 | 5.189 | 5.650 |
| 7.0 | 3.688 | 4.760 | 5.703 |
| 7.0 | 4.519 | 3.999 | 5.796 |
| 7.0 | 5.187 | 3.093 | 5.908 |
| 7.0 | 5.673 | 2.078 | 6.032 |
| 7.0 | 5.964 | 0.993 | 6.165 |
| 7.0 | 6.052 | −0.127 | 6.303 |
| 7.0 | 6.029 | −0.605 | 6.362 |
| 7.0 | 5.971 | −1.080 | 6.420 |
| 7.0 | 5.875 | −1.549 | 6.478 |
| 7.0 | 5.743 | −2.009 | 6.534 |

TABLE 1-continued

| Theta (deg.) | X | Y | Z |
|---|---|---|---|
| 7.0 | 5.576 | −2.457 | 6.589 |
| 7.0 | 5.112 | −3.361 | 6.700 |
| 7.0 | 4.503 | −4.176 | 6.800 |
| 7.0 | 3.765 | −4.879 | 6.886 |
| 7.0 | 2.918 | −5.447 | 6.956 |
| 7.0 | 1.985 | −5.861 | 7.007 |
| 7.0 | 1.598 | −5.979 | 7.021 |
| 7.0 | 1.205 | −6.072 | 7.033 |
| 7.0 | 0.806 | −6.139 | 7.041 |
| 7.0 | 0.404 | −6.180 | 7.046 |
| 7.0 | 0.000 | −6.193 | 7.048 |
| 7.0 | −0.404 | −6.180 | 7.046 |
| 7.0 | −0.806 | −6.139 | 7.041 |
| 7.0 | −1.205 | −6.072 | 7.033 |
| 7.0 | −1.598 | −5.979 | 7.021 |
| 7.0 | −1.985 | −5.861 | 7.007 |
| 7.0 | −3.765 | −4.879 | 6.886 |
| 7.0 | −4.503 | −4.176 | 6.800 |
| 7.0 | −5.112 | −3.361 | 6.700 |
| 7.0 | −5.576 | −2.457 | 6.589 |
| 7.0 | −5.743 | −2.009 | 6.534 |
| 7.0 | −5.875 | −1.549 | 6.478 |
| 7.0 | −5.971 | −1.080 | 6.420 |
| 7.0 | −6.029 | −0.605 | 6.362 |
| 7.0 | −6.052 | −0.127 | 6.303 |
| 7.0 | −5.964 | 0.993 | 6.165 |
| 7.0 | −5.673 | 2.078 | 6.032 |
| 7.0 | −5.187 | 3.093 | 5.908 |
| 7.0 | −4.519 | 3.999 | 5.796 |
| 7.0 | −3.688 | 4.760 | 5.703 |
| 7.0 | −3.024 | 5.189 | 5.650 |
| 7.0 | −2.313 | 5.535 | 5.608 |
| 7.0 | −1.565 | 5.793 | 5.576 |
| 7.0 | −0.790 | 5.954 | 5.556 |
| 8.0 | 0.000 | 5.941 | 6.362 |
| 8.0 | 0.801 | 5.884 | 6.370 |
| 8.0 | 1.586 | 5.718 | 6.393 |
| 8.0 | 2.343 | 5.452 | 6.430 |
| 8.0 | 3.060 | 5.093 | 6.481 |
| 8.0 | 3.725 | 4.648 | 6.543 |
| 8.0 | 4.532 | 3.886 | 6.650 |
| 8.0 | 5.179 | 2.987 | 6.777 |
| 8.0 | 5.649 | 1.986 | 6.918 |
| 8.0 | 5.930 | 0.917 | 7.068 |
| 8.0 | 6.016 | −0.184 | 7.222 |
| 8.0 | 5.994 | −0.661 | 7.289 |
| 8.0 | 5.935 | −1.134 | 7.356 |
| 8.0 | 5.839 | −1.602 | 7.422 |
| 8.0 | 5.707 | −2.061 | 7.486 |
| 8.0 | 5.541 | −2.508 | 7.549 |
| 8.0 | 5.087 | −3.389 | 7.673 |
| 8.0 | 4.495 | −4.186 | 7.785 |
| 8.0 | 3.780 | −4.876 | 7.882 |
| 8.0 | 2.959 | −5.440 | 7.961 |
| 8.0 | 2.055 | −5.862 | 8.020 |
| 8.0 | 1.657 | −5.994 | 8.039 |
| 8.0 | 1.250 | −6.097 | 8.053 |
| 8.0 | 0.837 | −6.171 | 8.064 |
| 8.0 | 0.420 | −6.215 | 8.070 |
| 8.0 | 0.000 | −6.230 | 8.072 |
| 8.0 | −0.420 | −6.215 | 8.070 |
| 8.0 | −0.837 | −6.171 | 8.064 |
| 8.0 | −1.250 | −6.097 | 8.053 |
| 8.0 | −2.055 | −5.862 | 8.020 |
| 8.0 | −2.959 | −5.440 | 7.961 |
| 8.0 | −3.780 | −4.876 | 7.882 |
| 8.0 | −4.495 | −4.186 | 7.785 |
| 8.0 | −5.087 | −3.389 | 7.673 |
| 8.0 | −5.541 | −2.508 | 7.549 |
| 8.0 | −5.707 | −2.061 | 7.486 |
| 8.0 | −5.839 | −1.602 | 7.422 |
| 8.0 | −5.935 | −1.134 | 7.356 |
| 8.0 | −5.994 | −0.661 | 7.289 |
| 8.0 | −6.016 | −0.184 | 7.222 |
| 8.0 | −5.930 | 0.917 | 7.068 |
| 8.0 | −5.649 | 1.986 | 6.918 |
| 8.0 | −5.179 | 2.987 | 6.777 |

TABLE 1-continued

| Theta (deg.) | X | Y | Z |
|---|---|---|---|
| 8.0 | −4.532 | 3.886 | 6.650 |
| 8.0 | −3.725 | 4.648 | 6.543 |
| 8.0 | −3.060 | 5.093 | 6.481 |
| 8.0 | −2.343 | 5.452 | 6.430 |
| 8.0 | −1.586 | 5.718 | 6.393 |
| 8.0 | −0.801 | 5.884 | 6.370 |
| 9.0 | 0.000 | 5.864 | 7.182 |
| 9.0 | 0.814 | 5.806 | 7.191 |
| 9.0 | 1.611 | 5.635 | 7.218 |
| 9.0 | 2.378 | 5.359 | 7.262 |
| 9.0 | 3.101 | 4.985 | 7.321 |
| 9.0 | 3.767 | 4.519 | 7.395 |
| 9.0 | 4.547 | 3.757 | 7.515 |
| 9.0 | 5.172 | 2.866 | 7.656 |
| 9.0 | 5.625 | 1.879 | 7.813 |
| 9.0 | 5.896 | 0.828 | 7.979 |
| 9.0 | 5.981 | −0.253 | 8.150 |
| 9.0 | 5.958 | −0.728 | 8.226 |
| 9.0 | 5.899 | −1.200 | 8.300 |
| 9.0 | 5.803 | −1.667 | 8.374 |
| 9.0 | 5.672 | −2.125 | 8.447 |
| 9.0 | 5.505 | −2.571 | 8.518 |
| 9.0 | 5.064 | −3.426 | 8.653 |
| 9.0 | 4.493 | −4.202 | 8.776 |
| 9.0 | 3.804 | −4.878 | 8.883 |
| 9.0 | 3.014 | −5.438 | 8.972 |
| 9.0 | 2.146 | −5.867 | 9.040 |
| 9.0 | 1.732 | −6.016 | 9.063 |
| 9.0 | 1.308 | −6.132 | 9.082 |
| 9.0 | 0.877 | −6.215 | 9.095 |
| 9.0 | 0.440 | −6.265 | 9.103 |
| 9.0 | 0.000 | −6.283 | 9.105 |
| 9.0 | −0.440 | −6.265 | 9.103 |
| 9.0 | −1.308 | −6.132 | 9.082 |
| 9.0 | −1.732 | −6.016 | 9.063 |
| 9.0 | −2.146 | −5.867 | 9.040 |
| 9.0 | −3.014 | −5.438 | 8.972 |
| 9.0 | −3.804 | −4.878 | 8.883 |
| 9.0 | −4.493 | −4.202 | 8.776 |
| 9.0 | −5.064 | −3.426 | 8.653 |
| 9.0 | −5.505 | −2.571 | 8.518 |
| 9.0 | −5.672 | −2.125 | 8.447 |
| 9.0 | −5.803 | −1.667 | 8.374 |
| 9.0 | −5.899 | −1.200 | 8.300 |
| 9.0 | −5.958 | −0.728 | 8.226 |
| 9.0 | −5.981 | −0.253 | 8.150 |
| 9.0 | −5.896 | 0.828 | 7.979 |
| 9.0 | −5.625 | 1.879 | 7.813 |
| 9.0 | −5.172 | 2.866 | 7.656 |
| 9.0 | −4.547 | 3.757 | 7.515 |
| 9.0 | −3.767 | 4.519 | 7.395 |
| 9.0 | −3.101 | 4.985 | 7.321 |
| 9.0 | −2.378 | 5.359 | 7.262 |
| 9.0 | −1.611 | 5.635 | 7.218 |
| 9.0 | −0.814 | 5.806 | 7.191 |
| 10.0 | 0.000 | 5.778 | 8.010 |
| 10.0 | 0.829 | 5.718 | 8.021 |
| 10.0 | 1.640 | 5.541 | 8.052 |
| 10.0 | 2.418 | 5.254 | 8.103 |
| 10.0 | 3.147 | 4.862 | 8.172 |
| 10.0 | 3.814 | 4.374 | 8.258 |
| 10.0 | 4.565 | 3.611 | 8.392 |
| 10.0 | 5.165 | 2.729 | 8.548 |
| 10.0 | 5.601 | 1.757 | 8.719 |
| 10.0 | 5.862 | 0.726 | 8.901 |
| 10.0 | 5.944 | −0.333 | 9.088 |
| 10.0 | 5.922 | −0.807 | 9.171 |
| 10.0 | 5.862 | −1.279 | 9.255 |
| 10.0 | 5.767 | −1.744 | 9.337 |
| 10.0 | 5.636 | −2.202 | 9.417 |
| 10.0 | 5.469 | −2.648 | 9.496 |
| 10.0 | 5.044 | −3.473 | 9.641 |
| 10.0 | 4.496 | −4.225 | 9.774 |
| 10.0 | 3.838 | −4.886 | 9.891 |
| 10.0 | 3.085 | −5.440 | 9.988 |
| 10.0 | 2.256 | −5.877 | 10.065 |
| 10.0 | 1.825 | −6.047 | 10.095 |

TABLE 1-continued

| Theta (deg.) | X | Y | Z |
|---|---|---|---|
| 10.0 | 1.380 | −6.178 | 10.118 |
| 10.0 | 0.925 | −6.272 | 10.135 |
| 10.0 | 0.464 | −6.330 | 10.145 |
| 10.0 | −0.464 | −6.330 | 10.145 |
| 10.0 | −0.925 | −6.272 | 10.135 |
| 10.0 | −1.380 | −6.178 | 10.118 |
| 10.0 | −1.825 | −6.047 | 10.095 |
| 10.0 | −2.256 | −5.877 | 10.065 |
| 10.0 | −3.085 | −5.440 | 9.988 |
| 10.0 | −3.838 | −4.886 | 9.891 |
| 10.0 | −4.496 | −4.225 | 9.774 |
| 10.0 | −5.044 | 3.473 | 9.641 |
| 10.0 | −5.469 | −2.648 | 9.496 |
| 10.0 | −5.636 | −2.202 | 9.417 |
| 10.0 | −5.767 | −1.744 | 9.337 |
| 10.0 | −5.862 | −1.279 | 9.255 |
| 10.0 | −5.922 | −0.807 | 9.171 |
| 10.0 | −5.944 | −0.333 | 9.088 |
| 10.0 | −5.862 | 0.726 | 8.901 |
| 10.0 | −5.601 | 1.757 | 8.719 |
| 10.0 | −5.165 | 2.729 | 8.548 |
| 10.0 | −4.565 | 3.611 | 8.392 |
| 10.0 | −3.814 | 4.374 | 8.258 |
| 10.0 | −3.147 | 4.862 | 8.172 |
| 10.0 | −2.418 | 5.254 | 8.103 |
| 10.0 | −1.640 | 5.541 | 8.052 |
| 10.0 | −0.829 | 5.718 | 8.021 |
| 11.0 | 0.000 | 5.683 | 8.849 |
| 11.0 | 0.846 | 5.621 | 8.861 |
| 11.0 | 1.672 | 5.437 | 8.897 |
| 11.0 | 2.463 | 5.136 | 8.955 |
| 11.0 | 3.200 | 4.724 | 9.035 |
| 11.0 | 3.867 | 4.211 | 9.135 |
| 11.0 | 4.586 | 3.448 | 9.283 |
| 11.0 | 5.160 | 2.575 | 9.453 |
| 11.0 | 5.577 | 1.620 | 9.639 |
| 11.0 | 5.828 | 0.611 | 9.835 |
| 11.0 | 5.908 | −0.425 | 10.036 |
| 11.0 | 5.885 | −0.899 | 10.128 |
| 11.0 | 5.825 | −1.370 | 10.220 |
| 11.0 | 5.730 | −1.835 | 10.310 |
| 11.0 | 5.600 | −2.292 | 10.399 |
| 11.0 | 5.433 | −2.738 | 10.486 |
| 11.0 | 5.026 | −3.530 | 10.640 |
| 11.0 | 4.505 | −4.256 | 10.781 |
| 11.0 | 3.882 | −4.900 | 10.906 |
| 11.0 | 3.171 | −5.448 | 11.012 |
| 11.0 | 2.387 | −5.891 | 11.099 |
| 11.0 | 1.934 | −6.085 | 11.136 |
| 11.0 | 1.465 | −6.236 | 11.166 |
| 11.0 | 0.494 | −6.410 | 11.200 |
| 11.0 | 0.000 | −6.433 | 11.204 |
| 11.0 | −0.494 | −6.410 | 11.200 |
| 11.0 | −0.983 | −6.344 | 11.187 |
| 11.0 | −1.465 | −6.236 | 11.166 |
| 11.0 | −1.934 | −6.085 | 11.136 |
| 11.0 | −2.387 | −5.891 | 11.099 |
| 11.0 | −3.171 | −5.448 | 11.012 |
| 11.0 | −3.882 | −4.900 | 10.906 |
| 11.0 | −4.505 | −4.256 | 10.781 |
| 11.0 | −5.026 | −3.530 | 10.640 |
| 11.0 | −5.433 | −2.738 | 10.486 |
| 11.0 | −5.600 | −2.292 | 10.399 |
| 11.0 | −5.730 | −1.835 | 10.310 |
| 11.0 | −5.825 | −1.370 | 10.220 |
| 11.0 | −5.885 | −0.899 | 10.128 |
| 11.0 | −5.908 | −0.425 | 10.036 |
| 11.0 | −5.828 | 0.611 | 9.835 |
| 11.0 | −5.577 | 1.620 | 9.639 |
| 11.0 | −5.160 | 2.575 | 9.453 |
| 11.0 | −4.586 | 3.448 | 9.283 |
| 11.0 | −3.867 | 4.211 | 9.135 |
| 11.0 | −3.200 | 4.724 | 9.035 |
| 11.0 | −2.463 | 5.136 | 8.955 |
| 11.0 | −1.672 | 5.437 | 8.897 |
| 11.0 | −0.846 | 5.621 | 8.861 |
| 12.0 | 0.000 | 5.578 | 9.699 |

TABLE 1-continued

| Theta (deg.) | X | Y | Z |
|---|---|---|---|
| 12.0 | 0.865 | 5.514 | 9.712 |
| 12.0 | 1.709 | 5.321 | 9.753 |
| 12.0 | 2.514 | 5.004 | 9.821 |
| 12.0 | 3.258 | 4.569 | 9.913 |
| 12.0 | 3.926 | 4.028 | 10.028 |
| 12.0 | 4.610 | 3.266 | 10.190 |
| 12.0 | 5.157 | 2.404 | 10.373 |
| 12.0 | 5.554 | 1.468 | 10.572 |
| 12.0 | 5.794 | 0.481 | 10.782 |
| 12.0 | 5.871 | −0.531 | 10.997 |
| 12.0 | 5.848 | −1.004 | 11.098 |
| 12.0 | 5.787 | −1.475 | 11.198 |
| 12.0 | 5.692 | −1.939 | 11.296 |
| 12.0 | 5.563 | −2.396 | 11.394 |
| 12.0 | 5.397 | −2.842 | 11.488 |
| 12.0 | 5.010 | −3.599 | 11.649 |
| 12.0 | 4.521 | −4.296 | 11.797 |
| 12.0 | 3.939 | −4.922 | 11.930 |
| 12.0 | 3.274 | −5.463 | 12.045 |
| 12.0 | 2.540 | −5.910 | 12.140 |
| 12.0 | 1.564 | −6.305 | 12.224 |
| 12.0 | 1.051 | −6.430 | 12.251 |
| 12.0 | 0.528 | −6.507 | 12.267 |
| 12.0 | 0.000 | −6.533 | 12.273 |
| 12.0 | −0.528 | −6.507 | 12.267 |
| 12.0 | −1.051 | −6.430 | 12.251 |
| 12.0 | −1.564 | −6.305 | 12.224 |
| 12.0 | −2.062 | −6.131 | 12.188 |
| 12.0 | −2.540 | −5.910 | 12.140 |
| 12.0 | −3.274 | −5.463 | 12.045 |
| 12.0 | −3.939 | −4.922 | 11.930 |
| 12.0 | −4.521 | −4.296 | 11.797 |
| 12.0 | −5.010 | −3.599 | 11.649 |
| 12.0 | −5.397 | −2.842 | 11.488 |
| 12.0 | −5.563 | −2.396 | 11.394 |
| 12.0 | −5.692 | −1.939 | 11.296 |
| 12.0 | −5.787 | −1.475 | 11.198 |
| 12.0 | −5.848 | −1.004 | 11.098 |
| 12.0 | −5.871 | −0.531 | 10.997 |
| 12.0 | −5.794 | 0.481 | 10.782 |
| 12.0 | −5.554 | 1.468 | 10.572 |
| 12.0 | −5.157 | 2.404 | 10.373 |
| 12.0 | −4.610 | 3.266 | 10.190 |
| 12.0 | −3.926 | 4.028 | 10.028 |
| 12.0 | −3.258 | 4.569 | 9.913 |
| 12.0 | −2.514 | 5.004 | 9.821 |
| 12.0 | −1.709 | 5.321 | 9.753 |
| 12.0 | −0.865 | 5.514 | 9.712 |
| 13.0 | 0.000 | 5.463 | 10.561 |
| 13.0 | 0.886 | 5.395 | 10.576 |
| 13.0 | 1.751 | 5.192 | 10.623 |
| 13.0 | 2.570 | 4.856 | 10.701 |
| 13.0 | 3.323 | 4.395 | 10.807 |
| 13.0 | 3.991 | 3.824 | 10.939 |
| 13.0 | 4.639 | 3.065 | 11.114 |
| 13.0 | 5.158 | 2.216 | 11.310 |
| 13.0 | 5.534 | 1.298 | 11.522 |
| 13.0 | 5.761 | 0.336 | 11.744 |
| 13.0 | 5.833 | −0.649 | 11.972 |
| 13.0 | 5.810 | −1.123 | 12.081 |
| 13.0 | 5.749 | −1.593 | 12.190 |
| 13.0 | 5.654 | −2.058 | 12.297 |
| 13.0 | 5.525 | −2.515 | 12.403 |
| 13.0 | 5.359 | −2.961 | 12.505 |
| 13.0 | 4.998 | −3.680 | 12.671 |
| 13.0 | 4.545 | −4.347 | 12.826 |
| 13.0 | 4.008 | −4.953 | 12.965 |
| 13.0 | 2.715 | −5.934 | 13.192 |
| 13.0 | 2.209 | −6.187 | 13.250 |
| 13.0 | 1.679 | −6.387 | 13.297 |
| 13.0 | 1.129 | −6.532 | 13.330 |
| 13.0 | 0.568 | −6.621 | 13.350 |
| 13.0 | 0.000 | −6.650 | 13.357 |
| 13.0 | −0.568 | −6.621 | 13.350 |
| 13.0 | −1.129 | −6.532 | 13.330 |
| 13.0 | −1.679 | −6.387 | 13.297 |
| 13.0 | −2.209 | −6.187 | 13.250 |

TABLE 1-continued

| Theta (deg.) | X | Y | Z |
|---|---|---|---|
| 13.0 | −2.715 | −5.934 | 13.192 |
| 13.0 | −3.395 | −5.485 | 13.088 |
| 13.0 | −4.008 | −4.953 | 12.965 |
| 13.0 | −4.545 | −4.347 | 12.826 |
| 13.0 | −4.998 | −3.680 | 12.671 |
| 13.0 | −5.359 | −2.961 | 12.505 |
| 13.0 | −5.525 | −2.515 | 12.403 |
| 13.0 | −5.654 | −2.058 | 12.297 |
| 13.0 | −5.749 | −1.593 | 12.190 |
| 13.0 | −5.810 | −1.123 | 12.081 |
| 13.0 | −5.833 | −0.649 | 11.972 |
| 13.0 | −5.761 | 0.336 | 11.744 |
| 13.0 | −5.534 | 1.298 | 11.522 |
| 13.0 | −5.158 | 2.216 | 11.310 |
| 13.0 | −4.639 | 3.065 | 11.114 |
| 13.0 | −3.991 | 3.824 | 10.939 |
| 13.0 | −3.323 | 4.395 | 10.807 |
| 13.0 | −2.570 | 4.856 | 10.701 |
| 13.0 | −1.751 | 5.192 | 10.623 |
| 13.0 | −0.886 | 5.395 | 10.576 |
| 14.0 | 0.000 | 5.337 | 11.437 |
| 14.0 | 0.911 | 5.265 | 11.455 |
| 14.0 | 1.797 | 5.049 | 11.508 |
| 14.0 | 2.633 | 4.691 | 11.598 |
| 14.0 | 3.394 | 4.202 | 11.720 |
| 14.0 | 4.062 | 3.597 | 11.870 |
| 14.0 | 4.674 | 2.843 | 12.058 |
| 14.0 | 5.162 | 2.008 | 12.267 |
| 14.0 | 5.515 | 1.112 | 12.490 |
| 14.0 | 5.728 | 0.175 | 12.724 |
| 14.0 | 5.795 | −0.783 | 12.962 |
| 14.0 | 5.771 | −1.256 | 13.080 |
| 14.0 | 5.710 | −1.727 | 13.198 |
| 14.0 | 5.615 | −2.192 | 13.314 |
| 14.0 | 5.486 | −2.649 | 13.428 |
| 14.0 | 5.321 | −3.095 | 13.539 |
| 14.0 | 4.989 | −3.774 | 13.708 |
| 14.0 | 4.092 | −4.995 | 14.013 |
| 14.0 | 3.535 | −5.516 | 14.143 |
| 14.0 | 2.912 | −5.962 | 14.254 |
| 14.0 | 2.375 | −6.253 | 14.326 |
| 14.0 | 1.809 | −6.483 | 14.384 |
| 14.0 | 1.219 | −6.651 | 14.426 |
| 14.0 | 0.614 | −8.753 | 14.451 |
| 14.0 | 0.000 | −6.786 | 14.459 |
| 14.0 | −0.614 | −6.753 | 14.451 |
| 14.0 | −1.219 | −6.651 | 14.426 |
| 14.0 | −1.809 | −6.483 | 14.384 |
| 14.0 | −2.375 | −6.253 | 14.326 |
| 14.0 | −2.912 | −5.962 | 14.254 |
| 14.0 | −3.535 | −5.516 | 14.143 |
| 14.0 | −4.092 | −4.995 | 14.012 |
| 14.0 | −4.578 | −4.410 | 13.867 |
| 14.0 | −4.989 | −3.774 | 13.708 |
| 14.0 | −5.321 | −3.095 | 13.539 |
| 14.0 | −5.486 | −2.649 | 13.428 |
| 14.0 | −5.615 | −2.192 | 13.314 |
| 14.0 | −5.710 | −1.727 | 13.198 |
| 14.0 | −5.771 | −1.256 | 13.080 |
| 14.0 | −5.795 | −0.783 | 12.962 |
| 14.0 | −5.728 | 0.175 | 12.724 |
| 14.0 | −5.515 | 1.112 | 12.490 |
| 14.0 | −5.162 | 2.008 | 12.267 |
| 14.0 | −4.674 | 2.843 | 12.058 |
| 14.0 | −4.062 | 3.597 | 11.870 |
| 14.0 | −3.394 | 4.202 | 11.720 |
| 14.0 | −2.633 | 4.691 | 11.598 |
| 14.0 | −1.797 | 5.049 | 11.508 |
| 14.0 | −0.911 | 5.265 | 11.455 |
| 15.0 | 0.000 | 5.199 | 12.328 |
| 15.0 | 0.938 | 5.122 | 12.348 |
| 15.0 | 1.848 | 4.890 | 12.410 |
| 15.0 | 2.702 | 4.507 | 12.513 |
| 15.0 | 3.473 | 3.985 | 12.653 |
| 15.0 | 4.142 | 3.345 | 12.824 |
| 15.0 | 4.715 | 2.599 | 13.024 |
| 15.0 | 5.171 | 1.780 | 13.244 |

TABLE 1-continued

| Theta (deg.) | X | Y | Z |
|---|---|---|---|
| 15.0 | 5.501 | 0.906 | 13.478 |
| 15.0 | 5.697 | −0.004 | 13.722 |
| 15.0 | 5.756 | −0.931 | 13.970 |
| 15.0 | 5.731 | −1.405 | 14.097 |
| 15.0 | 5.671 | −1.876 | 14.223 |
| 15.0 | 5.576 | −2.342 | 14.348 |
| 15.0 | 5.446 | −2.800 | 14.471 |
| 15.0 | 4.987 | −3.886 | 14.762 |
| 15.0 | 4.623 | −4.492 | 14.924 |
| 15.0 | 4.191 | −5.055 | 15.075 |
| 15.0 | 3.689 | −5.561 | 15.211 |
| 15.0 | 3.120 | −5.995 | 15.327 |
| 15.0 | 2.550 | −6.323 | 15.415 |
| 15.0 | 1.946 | −6.588 | 15.486 |
| 15.0 | 1.314 | −6.784 | 15.538 |
| 15.0 | 0.662 | −6.902 | 15.570 |
| 15.0 | 0.000 | −6.942 | 15.581 |
| 15.0 | −0.662 | −6.902 | 15.570 |
| 15.0 | −1.314 | −6.784 | 15.538 |
| 15.0 | −1.946 | −6.588 | 15.486 |
| 15.0 | −2.550 | −6.323 | 15.415 |
| 15.0 | −3.120 | −5.995 | 15.327 |
| 15.0 | −3.689 | −5.561 | 15.211 |
| 15.0 | −4.191 | −5.055 | 15.075 |
| 15.0 | −4.623 | −4.492 | 14.924 |
| 15.0 | −4.987 | −3.886 | 14.762 |
| 15.0 | −5.284 | −3.247 | 14.591 |
| 15.0 | −5.446 | −2.800 | 14.471 |
| 15.0 | −5.576 | −2.342 | 14.348 |
| 15.0 | −5.671 | −1.876 | 14.223 |
| 15.0 | −5.731 | −1.405 | 14.097 |
| 15.0 | −5.756 | −0.931 | 13.970 |
| 15.0 | −5.697 | −0.004 | 13.722 |
| 15.0 | −5.501 | 0.906 | 13.478 |
| 15.0 | −5.171 | 1.780 | 13.244 |
| 15.0 | −4.715 | 2.599 | 13.024 |
| 15.0 | −4.142 | 3.345 | 12.824 |
| 15.0 | −3.473 | 3.985 | 12.653 |
| 15.0 | −2.702 | 4.507 | 12.513 |
| 15.0 | −1.848 | 4.890 | 12.410 |
| 15.0 | −0.938 | 5.122 | 12.348 |
| 16.0 | 0.000 | 5.049 | 13.235 |
| 16.0 | 0.969 | 4.965 | 13.260 |
| 16.0 | 1.906 | 4.714 | 13.332 |
| 16.0 | 2.778 | 4.302 | 13.450 |
| 16.0 | 3.559 | 3.744 | 13.610 |
| 16.0 | 4.229 | 3.066 | 13.804 |
| 16.0 | 4.764 | 2.330 | 14.015 |
| 16.0 | 5.187 | 1.530 | 14.245 |
| 16.0 | 5.490 | 0.681 | 14.488 |
| 16.0 | 5.668 | −0.200 | 14.741 |
| 16.0 | 5.718 | −1.097 | 14.998 |
| 16.0 | 5.697 | −1.571 | 15.134 |
| 16.0 | 5.645 | −2.043 | 15.269 |
| 16.0 | 5.440 | −2.971 | 15.535 |
| 16.0 | 5.286 | −3.422 | 15.664 |
| 16.0 | 5.024 | −4.023 | 15.837 |
| 16.0 | 4.701 | −4.596 | 16.001 |
| 16.0 | 4.312 | −5.130 | 16.154 |
| 16.0 | 3.856 | −5.612 | 16.293 |
| 16.0 | 3.334 | −6.027 | 16.411 |
| 16.0 | 2.729 | −6.395 | 16.517 |
| 16.0 | 2.087 | −6.699 | 16.604 |
| 16.0 | 1.413 | −6.928 | 16.670 |
| 16.0 | 0.713 | −7.069 | 16.710 |
| 16.0 | 0.000 | −7.117 | 16.724 |
| 16.0 | −0.713 | −7.069 | 16.710 |
| 16.0 | −1.413 | −6.928 | 16.670 |
| 16.0 | −2.087 | −6.699 | 16.604 |
| 16.0 | −2.729 | −6.395 | 16.517 |
| 18.0 | −3.334 | −6.027 | 16.411 |
| 16.0 | −3.856 | −5.612 | 16.293 |
| 16.0 | −4.312 | −5.130 | 16.154 |
| 16.0 | −4.701 | −4.596 | 16.001 |
| 16.0 | −5.024 | −4.023 | 15.837 |
| 16.0 | −5.286 | −3.422 | 15.664 |
| 16.0 | −5.440 | −2.971 | 15.535 |

TABLE 1-continued

| Theta (deg.) | X | Y | Z |
|---|---|---|---|
| 16.0 | −5.561 | −2.511 | 15.403 |
| 16.0 | −5.645 | −2.043 | 15.269 |
| 16.0 | −5.697 | −1.571 | 15.134 |
| 16.0 | −5.718 | −1.097 | 14.998 |
| 16.0 | −5.668 | −0.200 | 14.741 |
| 16.0 | −5.490 | 0.681 | 14.488 |
| 16.0 | −5.187 | 1.530 | 14.245 |
| 16.0 | −4.764 | 2.330 | 14.015 |
| 16.0 | −4.229 | 3.066 | 13.804 |
| 16.0 | −3.559 | 3.744 | 13.610 |
| 16.0 | −2.778 | 4.302 | 13.450 |
| 16.0 | −1.906 | 4.714 | 13.332 |
| 16.0 | −0.969 | 4.965 | 13.260 |
| 17.0 | 0.000 | 4.885 | 14.162 |
| 17.0 | 1.003 | 4.793 | 14.190 |
| 17.0 | 1.969 | 4.519 | 14.274 |
| 17.0 | 2.862 | 4.072 | 14.410 |
| 17.0 | 3.654 | 3.475 | 14.593 |
| 17.0 | 4.326 | 2.757 | 14.813 |
| 17.0 | 4.823 | 2.033 | 15.034 |
| 17.0 | 5.212 | 1.252 | 15.273 |
| 17.0 | 5.490 | 0.428 | 15.525 |
| 17.0 | 5.661 | −0.422 | 15.784 |
| 17.0 | 5.728 | −1.286 | 16.048 |
| 17.0 | 5.691 | −2.235 | 16.339 |
| 17.0 | 5.619 | −2.705 | 16.482 |
| 17.0 | 5.502 | −3.167 | 16.624 |
| 17.0 | 5.346 | −3.618 | 16.762 |
| 17.0 | 5.104 | −4.177 | 16.933 |
| 17.0 | 4.809 | −4.713 | 17.096 |
| 17.0 | 4.453 | −5.213 | 17.249 |
| 17.0 | 4.032 | −5.664 | 17.387 |
| 17.0 | 3.549 | −6.055 | 17.506 |
| 17.0 | 2.909 | −6.456 | 17.629 |
| 17.0 | 2.229 | −6.791 | 17.732 |
| 17.0 | 1.511 | −7.044 | 17.809 |
| 17.0 | 0.763 | −7.200 | 17.857 |
| 17.0 | 0.000 | −7.252 | 17.872 |
| 17.0 | −0.763 | −7.200 | 17.857 |
| 17.0 | −1.511 | −7.044 | 17.809 |
| 17.0 | −2.229 | −6.791 | 17.732 |
| 17.0 | −2.909 | −6.456 | 17.629 |
| 17.0 | −3.549 | −6.055 | 17.506 |
| 17.0 | −4.032 | −5.664 | 17.387 |
| 17.0 | −4.453 | −5.213 | 17.249 |
| 17.0 | −4.809 | −4.713 | 17.096 |
| 17.0 | −5.104 | −4.177 | 16.933 |
| 17.0 | −5.346 | −3.618 | 16.762 |
| 17.0 | −5.502 | −3.167 | 16.624 |
| 17.0 | −5.619 | −2.705 | 16.482 |
| 17.0 | −5.691 | −2.235 | 16.339 |
| 17.0 | −5.725 | −1.761 | 16.194 |
| 17.0 | −5.728 | −1.286 | 16.048 |
| 17.0 | −5.661 | −0.422 | 15.784 |
| 17.0 | −5.490 | 0.428 | 15.525 |
| 17.0 | −5.212 | 1.252 | 15.273 |
| 17.0 | −4.823 | 2.033 | 15.034 |
| 17.0 | −4.326 | 2.757 | 14.813 |
| 17.0 | −3.654 | 3.475 | 14.593 |
| 17.0 | −2.862 | 4.072 | 14.410 |
| 17.0 | −1.969 | 4.519 | 14.274 |
| 17.0 | −1.003 | 4.793 | 14.190 |
| 18.0 | 0.000 | 4.707 | 15.109 |
| 18.0 | 1.043 | 4.605 | 15.142 |
| 18.0 | 2.041 | 4.302 | 15.240 |
| 18.0 | 2.956 | 3.815 | 15.398 |
| 18.0 | 3.759 | 3.173 | 15.607 |
| 18.0 | 4.432 | 2.408 | 15.855 |
| 18.0 | 4.892 | 1.701 | 16.085 |
| 18.0 | 5.256 | 0.945 | 16.331 |
| 18.0 | 5.529 | 0.154 | 16.588 |
| 18.0 | 5.803 | −1.487 | 17.121 |
| 18.0 | 5.819 | −1.963 | 17.276 |
| 18.0 | 5.804 | −2.439 | 17.431 |
| 18.0 | 5.740 | −2.912 | 17.584 |
| 18.0 | 5.620 | −3.375 | 17.734 |
| 18.0 | 5.454 | −3.824 | 17.881 |

TABLE 1-continued

| Theta (deg.) | X | Y | Z |
|---|---|---|---|
| 18.0 | 5.222 | −4.340 | 18.048 |
| 18.0 | 4.944 | −4.834 | 18.209 |
| 18.0 | 4.610 | −5.296 | 18.359 |
| 18.0 | 4.217 | −5.713 | 18.494 |
| 18.0 | 3.765 | −6.072 | 18.611 |
| 18.0 | 3.086 | −6.494 | 18.748 |
| 18.0 | 2.364 | −6.845 | 18.862 |
| 18.0 | 1.602 | −7.107 | 18.947 |
| 18.0 | 0.809 | −7.267 | 18.999 |
| 18.0 | 0.000 | −7.320 | 19.016 |
| 18.0 | −0.809 | −7.267 | 18.999 |
| 18.0 | −1.602 | −7.107 | 18.947 |
| 18.0 | −2.364 | −6.845 | 18.862 |
| 18.0 | −3.086 | −6.494 | 18.748 |
| 18.0 | −3.765 | −6.072 | 18.611 |
| 18.0 | −4.217 | −5.713 | 18.494 |
| 18.0 | −4.610 | −5.296 | 18.359 |
| 18.0 | −4.944 | −4.834 | 18.209 |
| 18.0 | −5.222 | −4.340 | 18.048 |
| 18.0 | −5.454 | −3.824 | 17.881 |
| 18.0 | −5.620 | −3.375 | 17.734 |
| 18.0 | −5.740 | −2.912 | 17.584 |
| 18.0 | −5.804 | −2.439 | 17.431 |
| 18.0 | −5.819 | −1.963 | 17.276 |
| 18.0 | −5.803 | −1.487 | 17.121 |
| 18.0 | −5.711 | −0.659 | 16.852 |
| 18.0 | −5.529 | 0.154 | 16.588 |
| 18.0 | −5.256 | 0.945 | 16.331 |
| 18.0 | −4.892 | 1.701 | 16.085 |
| 18.0 | −4.432 | 2.408 | 15.855 |
| 18.0 | −3.759 | 3.173 | 15.607 |
| 18.0 | −2.956 | 3.815 | 15.398 |
| 18.0 | −2.041 | 4.302 | 15.240 |
| 18.0 | −1.043 | 4.605 | 15.142 |
| 19.0 | 0.000 | 4.513 | 16.078 |
| 19.0 | 1.091 | 4.396 | 16.118 |
| 19.0 | 2.126 | 4.053 | 16.236 |
| 19.0 | 3.061 | 3.507 | 16.424 |
| 19.0 | 3.868 | 2.803 | 16.667 |
| 19.0 | 4.550 | 1.988 | 16.947 |
| 19.0 | 4.983 | 1.316 | 17.179 |
| 19.0 | 5.614 | −0.137 | 17.679 |
| 19.0 | 5.813 | −0.901 | 17.942 |
| 19.0 | 5.932 | −1.679 | 18.210 |
| 19.0 | 5.968 | −2.159 | 18.375 |
| 19.0 | 5.968 | −2.639 | 18.541 |
| 19.0 | 5.908 | −3.116 | 18.705 |
| 19.0 | 5.779 | −3.581 | 18.865 |
| 19.0 | 5.598 | −4.030 | 19.019 |
| 19.0 | 5.368 | −4.500 | 19.181 |
| 19.0 | 5.099 | −4.951 | 19.337 |
| 19.0 | 4.779 | −5.372 | 19.481 |
| 19.0 | 4.405 | −5.750 | 19.612 |
| 19.0 | 3.979 | −6.075 | 19.724 |
| 19.0 | 3.258 | −6.504 | 19.871 |
| 19.0 | 2.492 | −6.856 | 19.993 |
| 19.0 | 1.686 | −7.115 | 20.082 |
| 19.0 | 0.850 | −7.271 | 20.135 |
| 19.0 | 0.000 | −7.323 | 20.153 |
| 19.0 | −0.850 | −7.271 | 20.135 |
| 19.0 | −1.686 | −7.115 | 20.082 |
| 19.0 | −2.492 | −6.856 | 19.993 |
| 19.0 | −3.258 | −6.504 | 19.871 |
| 19.0 | −3.979 | −6.075 | 19.724 |
| 19.0 | −4.405 | −5.750 | 19.612 |
| 19.0 | −4.779 | −5.372 | 19.481 |
| 19.0 | −5.099 | −4.951 | 19.337 |
| 19.0 | −5.368 | −4.500 | 19.181 |
| 19.0 | −5.598 | −4.030 | 19.019 |
| 19.0 | −5.779 | −3.581 | 18.865 |
| 19.0 | −5.908 | −3.116 | 18.705 |
| 19.0 | −5.968 | −2.639 | 18.541 |
| 19.0 | −5.968 | −2.159 | 18.375 |
| 19.0 | −5.932 | −1.679 | 18.210 |
| 19.0 | −5.813 | −0.901 | 17.942 |
| 19.0 | −5.614 | −0.137 | 17.679 |
| 19.0 | −5.337 | 0.605 | 17.424 |

TABLE 1-continued

| Theta (deg.) | X | Y | Z |
|---|---|---|---|
| 19.0 | −4.983 | 1.316 | 17.179 |
| 19.0 | −4.550 | 1.988 | 16.947 |
| 19.0 | −3.868 | 2.803 | 16.667 |
| 19.0 | −3.061 | 3.507 | 16.424 |
| 19.0 | −2.126 | 4.053 | 16.236 |
| 19.0 | −1.091 | 4.396 | 16.118 |
| 20.0 | 0.000 | 4.270 | 17.083 |
| 20.0 | 1.137 | 4.130 | 17.134 |
| 20.0 | 2.202 | 3.729 | 17.280 |
| 20.0 | 3.149 | 3.120 | 17.502 |
| 20.0 | 3.970 | 2.365 | 17.777 |
| 20.0 | 5.103 | 0.904 | 18.309 |
| 20.0 | 5.455 | 0.254 | 18.545 |
| 20.0 | 5.742 | −0.424 | 18.792 |
| 20.0 | 5.960 | −1.124 | 19.047 |
| 20.0 | 6.100 | −1.842 | 19.308 |
| 20.0 | 6.154 | −2.327 | 19.485 |
| 20.0 | 6.164 | −2.816 | 19.662 |
| 20.0 | 6.103 | −3.300 | 19.839 |
| 20.0 | 5.962 | −3.770 | 20.010 |
| 20.0 | 5.761 | −4.220 | 20.174 |
| 20.0 | 5.531 | −4.646 | 20.329 |
| 20.0 | 5.264 | −5.053 | 20.477 |
| 20.0 | 4.953 | −5.431 | 20.614 |
| 20.0 | 4.594 | −5.769 | 20.737 |
| 20.0 | 4.188 | −6.057 | 20.842 |
| 20.0 | 3.423 | −6.481 | 20.996 |
| 20.0 | 2.611 | −6.821 | 21.120 |
| 20.0 | 1.762 | −7.067 | 21.210 |
| 20.0 | 0.887 | −7.214 | 21.263 |
| 20.0 | 0.000 | −7.262 | 21.281 |
| 20.0 | −0.887 | −7.214 | 21.263 |
| 20.0 | −1.762 | −7.067 | 21.210 |
| 20.0 | −2.611 | −6.821 | 21.120 |
| 20.0 | −3.423 | −6.481 | 20.996 |
| 20.0 | −4.188 | −6.057 | 20.842 |
| 20.0 | −4.594 | −5.769 | 20.737 |
| 20.0 | −4.953 | −5.431 | 20.614 |
| 20.0 | −5.264 | −5.053 | 20.477 |
| 20.0 | −5.531 | −4.646 | 20.329 |
| 20.0 | −5.761 | −4.220 | 20.174 |
| 20.0 | −5.962 | −3.770 | 20.010 |
| 20.0 | −6.103 | −3.300 | 19.839 |
| 20.0 | −6.164 | −2.816 | 19.662 |
| 20.0 | −6.154 | −2.328 | 19.485 |
| 20.0 | −6.100 | −1.842 | 19.308 |
| 20.0 | −5.960 | −1.124 | 19.047 |
| 20.0 | −5.742 | −0.424 | 18.792 |
| 20.0 | −5.455 | 0.254 | 18.545 |
| 20.0 | −5.103 | 0.904 | 18.309 |
| 20.0 | −4.684 | 1.518 | 18.085 |
| 20.0 | −3.970 | 2.365 | 17.777 |
| 20.0 | −3.149 | 3.120 | 17.502 |
| 20.0 | −2.202 | 3.729 | 17.280 |
| 20.0 | −1.137 | 4.130 | 17.134 |
| 21.0 | 0.000 | 3.932 | 18.147 |
| 21.0 | 1.173 | 3.768 | 18.210 |
| 21.0 | 2.258 | 3.320 | 18.382 |
| 21.0 | 4.069 | 1.892 | 18.930 |
| 21.0 | 4.839 | 1.045 | 19.255 |
| 21.0 | 5.253 | 0.504 | 19.463 |
| 21.0 | 5.610 | −0.070 | 19.683 |
| 21.0 | 5.907 | −0.674 | 19.915 |
| 21.0 | 6.138 | −1.302 | 20.156 |
| 21.0 | 6.292 | −1.950 | 20.405 |
| 21.0 | 6.360 | −2.448 | 20.596 |
| 21.0 | 6.372 | −2.949 | 20.788 |
| 21.0 | 6.302 | −3.446 | 20.979 |
| 21.0 | 6.147 | −3.925 | 21.163 |
| 21.0 | 5.927 | −4.383 | 21.339 |
| 21.0 | 5.697 | −4.767 | 21.486 |
| 21.0 | 5.432 | −5.131 | 21.626 |
| 21.0 | 5.126 | −5.466 | 21.754 |
| 21.0 | 4.778 | −5.762 | 21.868 |
| 21.0 | 4.391 | −6.013 | 21.965 |
| 21.0 | 3.578 | −6.419 | 22.120 |
| 21.0 | 2.721 | −6.736 | 22.242 |

TABLE 1-continued

| Theta (deg.) | X | Y | Z |
|---|---|---|---|
| 21.0 | 1.831 | −6.961 | 22.328 |
| 21.0 | 0.921 | −7.094 | 22.380 |
| 21.0 | 0.000 | −7.138 | 22.396 |
| 21.0 | −0.921 | −7.094 | 22.380 |
| 21.0 | −1.831 | −6.961 | 22.328 |
| 21.0 | −2.721 | −6.736 | 22.242 |
| 21.0 | −3.578 | −6.419 | 22.120 |
| 21.0 | −4.391 | −6.013 | 21.965 |
| 21.0 | −4.778 | −5.762 | 21.868 |
| 21.0 | −5.126 | −5.466 | 21.754 |
| 21.0 | −5.432 | −5.131 | 21.626 |
| 21.0 | −5.697 | −4.767 | 21.486 |
| 21.0 | −5.927 | −4.383 | 21.339 |
| 21.0 | −6.147 | −3.925 | 21.163 |
| 21.0 | −6.302 | −3.446 | 20.979 |
| 21.0 | −6.372 | −2.949 | 20.788 |
| 21.0 | −6.360 | −2.448 | 20.596 |
| 21.0 | −6.292 | −1.950 | 20.405 |
| 21.0 | −6.138 | −1.302 | 20.156 |
| 21.0 | −5.907 | −0.674 | 19.915 |
| 21.0 | −5.610 | −0.070 | 19.683 |
| 21.0 | −5.253 | 0.504 | 19.463 |
| 21.0 | −4.839 | 1.045 | 19.255 |
| 21.0 | −4.069 | 1.892 | 18.930 |
| 21.0 | −3.220 | 2.668 | 18.632 |
| 21.0 | −2.258 | 3.320 | 18.382 |
| 21.0 | −1.173 | 3.768 | 18.210 |
| 22.0 | 0.000 | 3.467 | 19.288 |
| 22.0 | 2.288 | 2.825 | 19.548 |
| 22.0 | 3.273 | 2.176 | 19.810 |
| 22.0 | 4.173 | 1.426 | 20.113 |
| 22.0 | 5.018 | 0.623 | 20.437 |
| 22.0 | 5.433 | 0.167 | 20.621 |
| 22.0 | 5.794 | −0.326 | 20.820 |
| 22.0 | 6.097 | −0.851 | 21.033 |
| 22.0 | 6.334 | −1.405 | 21.256 |
| 22.0 | 6.492 | −1.983 | 21.490 |
| 22.0 | 6.567 | −2.499 | 21.699 |
| 22.0 | 6.569 | −3.020 | 21.909 |
| 22.0 | 6.483 | −3.535 | 22.117 |
| 22.0 | 6.315 | −4.032 | 22.318 |
| 22.0 | 6.079 | −4.505 | 22.509 |
| 22.0 | 5.854 | −4.852 | 22.649 |
| 22.0 | 5.592 | −5.175 | 22.780 |
| 22.0 | 5.291 | −5.468 | 22.898 |
| 22.0 | 4.953 | −5.724 | 23.002 |
| 22.0 | 4.583 | −5.940 | 23.089 |
| 22.0 | 3.722 | −6.315 | 23.240 |
| 22.0 | 2.821 | −6.599 | 23.355 |
| 22.0 | 1.894 | −6.797 | 23.435 |
| 22.0 | 0.951 | −6.914 | 23.482 |
| 22.0 | 0.000 | −6.953 | 23.498 |
| 22.0 | −0.951 | −6.914 | 23.482 |
| 22.0 | −1.894 | −6.797 | 23.435 |
| 22.0 | −2.821 | −6.599 | 23.355 |
| 22.0 | −3.722 | −6.315 | 23.240 |
| 22.0 | −4.583 | −5.940 | 23.089 |
| 22.0 | −4.953 | −5.724 | 23.002 |
| 22.0 | −5.291 | −5.468 | 22.898 |
| 22.0 | −5.592 | −5.175 | 22.780 |
| 22.0 | −5.854 | −4.852 | 22.649 |
| 22.0 | −6.079 | −4.505 | 22.509 |
| 22.0 | −6.315 | −4.032 | 22.318 |
| 22.0 | −6.483 | −3.535 | 22.117 |
| 22.0 | −6.569 | −3.020 | 21.909 |
| 22.0 | −6.567 | −2.499 | 21.699 |
| 22.0 | −6.492 | −1.983 | 21.490 |
| 22.0 | −6.334 | −1.405 | 21.256 |
| 22.0 | −6.097 | −0.851 | 21.033 |
| 22.0 | −5.794 | −0.326 | 20.820 |
| 22.0 | −5.433 | 0.167 | 20.621 |
| 22.0 | −5.018 | 0.623 | 20.437 |
| 22.0 | −4.173 | 1.426 | 20.113 |
| 22.0 | −3.273 | 2.176 | 19.810 |
| 22.0 | −2.288 | 2.825 | 19.548 |
| 23.0 | 0.000 | 2.826 | 20.536 |
| 23.0 | 1.186 | 2.662 | 20.606 |

TABLE 1-continued

| Theta (deg.) | X | Y | Z |
|---|---|---|---|
| 23.0 | 2.296 | 2.239 | 20.785 |
| 23.0 | 3.324 | 1.665 | 21.029 |
| 23.0 | 4.295 | 1.011 | 21.307 |
| 23.0 | 5.224 | 0.307 | 21.606 |
| 23.0 | 5.635 | −0.063 | 21.763 |
| 23.0 | 5.995 | −0.476 | 21.938 |
| 23.0 | 6.297 | −0.927 | 22.129 |
| 23.0 | 6.531 | −1.410 | 22.334 |
| 23.0 | 6.683 | −1.920 | 22.551 |
| 23.0 | 6.752 | −2.465 | 22.782 |
| 23.0 | 6.732 | −3.013 | 23.015 |
| 23.0 | 6.627 | −3.553 | 23.244 |
| 23.0 | 6.449 | −4.076 | 23.466 |
| 23.0 | 6.201 | −4.575 | 23.678 |
| 23.0 | 5.988 | −4.889 | 23.811 |
| 23.0 | 5.733 | −5.177 | 23.933 |
| 23.0 | 5.441 | −5.431 | 24.041 |
| 23.0 | 5.116 | −5.651 | 24.134 |
| 23.0 | 4.764 | −5.831 | 24.211 |
| 23.0 | 3.855 | −6.164 | 24.352 |
| 23.0 | 2.913 | −6.407 | 24.455 |
| 23.0 | 1.951 | −6.574 | 24.526 |
| 23.0 | 0.978 | −6.674 | 24.569 |
| 23.0 | 0.000 | −6.709 | 24.583 |
| 23.0 | −0.978 | −6.674 | 24.569 |
| 23.0 | −1.951 | −6.574 | 24.526 |
| 23.0 | −2.913 | −6.407 | 24.455 |
| 23.0 | −3.855 | −6.164 | 24.352 |
| 23.0 | −4.764 | −5.831 | 24.211 |
| 23.0 | −5.116 | −5.651 | 24.134 |
| 23.0 | −5.441 | −5.431 | 24.041 |
| 23.0 | −5.733 | −5.177 | 23.933 |
| 23.0 | −5.988 | −4.889 | 23.811 |
| 23.0 | −6.201 | −4.575 | 23.678 |
| 23.0 | −6.449 | −4.076 | 23.466 |
| 23.0 | −6.627 | −3.553 | 23.244 |
| 23.0 | −6.732 | −3.013 | 23.015 |
| 23.0 | −6.752 | −2.465 | 22.782 |
| 23.0 | −6.683 | −1.920 | 22.551 |
| 23.0 | −6.531 | −1.410 | 22.334 |
| 23.0 | −6.297 | −0.927 | 22.129 |
| 23.0 | −5.995 | −0.476 | 21.938 |
| 23.0 | −5.635 | −0.063 | 21.763 |
| 23.0 | −5.224 | 0.307 | 21.606 |
| 23.0 | −4.295 | 1.011 | 21.307 |
| 23.0 | −2.296 | 2.239 | 20.785 |
| 23.0 | −1.186 | 2.662 | 20.606 |
| 24.0 | 0.000 | 2.094 | 21.866 |
| 24.0 | 1.182 | 1.985 | 21.915 |
| 24.0 | 2.326 | 1.688 | 22.047 |
| 24.0 | 3.416 | 1.254 | 22.240 |
| 24.0 | 4.457 | 0.726 | 22.475 |
| 24.0 | 5.454 | 0.133 | 22.739 |
| 24.0 | 5.851 | −0.159 | 22.869 |
| 24.0 | 6.200 | −0.498 | 23.021 |
| 24.0 | 6.492 | −0.881 | 23.191 |
| 24.0 | 6.714 | −1.300 | 23.377 |
| 24.0 | 6.850 | −1.749 | 23.577 |
| 24.0 | 6.898 | −2.332 | 23.837 |
| 24.0 | 6.848 | −2.915 | 24.096 |
| 24.0 | 6.725 | −3.489 | 24.352 |
| 24.0 | 6.542 | −4.050 | 24.602 |
| 24.0 | 6.291 | −4.588 | 24.841 |
| 24.0 | 6.094 | −4.874 | 24.969 |
| 24.0 | 5.853 | −5.130 | 25.083 |
| 24.0 | 5.573 | −5.351 | 25.181 |
| 24.0 | 5.264 | −5.536 | 25.264 |
| 24.0 | 4.932 | −5.684 | 25.329 |
| 24.0 | 3.977 | −5.965 | 25.454 |
| 24.0 | 2.996 | −6.160 | 25.541 |
| 24.0 | 2.003 | −6.294 | 25.601 |
| 24.0 | 1.003 | −6.376 | 25.637 |
| 24.0 | 0.000 | −6.405 | 25.650 |
| 24.0 | −1.003 | −6.376 | 25.637 |
| 24.0 | −2.003 | −6.294 | 25.601 |
| 24.0 | −2.996 | −6.160 | 25.541 |
| 24.0 | −3.977 | −5.965 | 25.454 |

TABLE 1-continued

| Theta (deg.) | X | Y | Z |
|---|---|---|---|
| 24.0 | −4.932 | −5.684 | 25.329 |
| 24.0 | −5.264 | −5.536 | 25.264 |
| 24.0 | −5.573 | −5.351 | 25.181 |
| 24.0 | −5.853 | −5.130 | 25.083 |
| 24.0 | −6.094 | −4.874 | 24.969 |
| 24.0 | −6.291 | −4.588 | 24.841 |
| 24.0 | −6.542 | −4.050 | 24.602 |
| 24.0 | −6.725 | −3.489 | 24.352 |
| 24.0 | −6.848 | −2.915 | 24.096 |
| 24.0 | −6.898 | −2.332 | 23.837 |
| 24.0 | −6.850 | −1.749 | 23.577 |
| 24.0 | −6.714 | −1.300 | 23.377 |
| 24.0 | −6.492 | −0.881 | 23.191 |
| 24.0 | −6.200 | −0.498 | 23.021 |
| 24.0 | −5.851 | −0.159 | 22.869 |
| 24.0 | −4.457 | 0.726 | 22.475 |
| 24.0 | −3.416 | 1.254 | 22.240 |
| 24.0 | −2.326 | 1.688 | 22.047 |
| 24.0 | −1.182 | 1.985 | 21.915 |
| 25.0 | 0.000 | 1.655 | 23.106 |
| 25.0 | 1.199 | 1.580 | 23.141 |
| 25.0 | 2.378 | 1.365 | 23.242 |
| 25.0 | 3.524 | 1.035 | 23.395 |
| 25.0 | 4.633 | 0.614 | 23.592 |
| 25.0 | 5.703 | 0.116 | 23.824 |
| 25.0 | 6.076 | −0.112 | 23.930 |
| 25.0 | 6.405 | −0.392 | 24.061 |
| 25.0 | 6.676 | −0.717 | 24.212 |
| 25.0 | 6.877 | −1.082 | 24.383 |
| 25.0 | 6.990 | −1.477 | 24.567 |
| 25.0 | 7.003 | −2.105 | 24.860 |
| 25.0 | 6.923 | −2.730 | 25.151 |
| 25.0 | 6.787 | −3.346 | 25.438 |
| 25.0 | 6.603 | −3.952 | 25.721 |
| 25.0 | 6.354 | −4.539 | 25.995 |
| 25.0 | 6.178 | −4.801 | 26.117 |
| 25.0 | 5.953 | −5.030 | 26.224 |
| 25.0 | 5.688 | −5.222 | 26.313 |
| 25.0 | 5.396 | −5.377 | 26.385 |
| 25.0 | 5.083 | −5.494 | 26.440 |
| 25.0 | 4.086 | −5.713 | 26.542 |
| 25.0 | 3.072 | −5.858 | 26.610 |
| 25.0 | 2.051 | −5.958 | 26.656 |
| 25.0 | 1.026 | −6.020 | 26.685 |
| 25.0 | 0.000 | −6.043 | 26.696 |
| 25.0 | −1.026 | −6.020 | 26.685 |
| 25.0 | −2.051 | −5.958 | 26.656 |
| 25.0 | −3.072 | −5.858 | 26.610 |
| 25.0 | −4.086 | −5.713 | 26.542 |
| 25.0 | −5.083 | −5.494 | 26.440 |
| 25.0 | −5.396 | −5.377 | 26.385 |
| 25.0 | −5.688 | −5.222 | 26.313 |
| 25.0 | −5.953 | −5.030 | 26.224 |
| 25.0 | −6.178 | −4.801 | 26.117 |
| 25.0 | −6.354 | −4.539 | 25.995 |
| 25.0 | 6.603 | −3.952 | 25.721 |
| 25.0 | −6.787 | −3.346 | 25.438 |
| 25.0 | −6.923 | −2.730 | 25.151 |
| 25.0 | −7.003 | −2.105 | 24.860 |
| 25.0 | −6.990 | −1.477 | 24.567 |
| 25.0 | −6.877 | −1.082 | 24.383 |
| 25.0 | −6.676 | −0.717 | 24.212 |
| 25.0 | −6.076 | −0.112 | 23.930 |
| 25.0 | −5.703 | 0.116 | 23.824 |
| 25.0 | −4.633 | 0.614 | 23.592 |
| 25.0 | −3.524 | 1.035 | 23.395 |
| 25.0 | −2.378 | 1.365 | 23.242 |
| 25.0 | −1.199 | 1.580 | 23.141 |
| 26.0 | 0.000 | 1.438 | 24.274 |
| 26.0 | 1.228 | 1.384 | 24.300 |
| 26.0 | 2.445 | 1.227 | 24.377 |
| 26.0 | 3.642 | 0.976 | 24.499 |
| 26.0 | 4.814 | 0.644 | 24.661 |
| 26.0 | 5.954 | 0.230 | 24.863 |
| 26.0 | 6.298 | 0.052 | 24.950 |
| 26.0 | 6.598 | −0.180 | 25.063 |
| 26.0 | 6.844 | −0.460 | 25.199 |

TABLE 1-continued

| Theta (deg.) | X | Y | Z |
|---|---|---|---|
| 26.0 | 7.018 | −0.780 | 25.355 |
| 26.0 | 7.104 | −1.127 | 25.525 |
| 26.0 | 7.076 | −1.801 | 25.853 |
| 26.0 | 6.968 | −2.469 | 26.179 |
| 26.0 | 6.820 | −3.131 | 26.502 |
| 26.0 | 6.635 | −3.785 | 26.821 |
| 26.0 | 6.395 | −4.424 | 27.133 |
| 26.0 | 6.241 | −4.666 | 27.251 |
| 26.0 | 6.034 | −4.873 | 27.352 |
| 26.0 | 5.786 | −5.040 | 27.433 |
| 26.0 | 5.511 | −5.169 | 27.496 |
| 26.0 | 5.217 | −5.257 | 27.539 |
| 26.0 | 4.183 | −5.408 | 27.613 |
| 26.0 | 3.140 | −5.502 | 27.658 |
| 26.0 | 2.095 | −5.566 | 27.690 |
| 26.0 | 1.048 | −5.609 | 27.711 |
| 26.0 | 0.000 | −5.625 | 27.719 |
| 26.0 | −1.048 | −5.609 | 27.711 |
| 26.0 | −2.095 | −5.566 | 27.690 |
| 26.0 | −3.140 | −5.502 | 27.658 |
| 26.0 | −4.183 | −5.408 | 27.613 |
| 26.0 | −5.217 | −5.257 | 27.539 |
| 26.0 | −5.511 | −5.169 | 27.496 |
| 26.0 | −5.786 | −5.040 | 27.433 |
| 26.0 | −6.034 | −4.873 | 27.352 |
| 26.0 | −6.241 | −4.666 | 27.251 |
| 26.0 | −6.395 | −4.424 | 27.133 |
| 26.0 | −6.635 | −3.785 | 26.821 |
| 26.0 | −6.820 | −3.131 | 26.502 |
| 26.0 | −6.968 | −2.469 | 26.179 |
| 26.0 | −7.076 | −1.801 | 25.853 |
| 26.0 | −7.104 | −1.127 | 25.525 |
| 26.0 | −6.844 | −0.460 | 25.199 |
| 26.0 | −6.598 | −0.180 | 25.063 |
| 26.0 | −6.298 | 0.052 | 24.950 |
| 26.0 | −5.954 | 0.230 | 24.863 |
| 26.0 | −4.814 | 0.644 | 24.661 |
| 26.0 | −3.642 | 0.976 | 24.499 |
| 26.0 | −2.445 | 1.227 | 24.377 |
| 26.0 | −1.228 | 1.384 | 24.300 |
| 27.0 | 0.000 | 1.395 | 25.380 |
| 27.0 | 1.261 | 1.355 | 25.401 |
| 27.0 | 2.516 | 1.237 | 25.461 |
| 27.0 | 3.760 | 1.046 | 25.558 |
| 27.0 | 4.988 | 0.785 | 25.691 |
| 27.0 | 6.191 | 0.447 | 25.863 |
| 27.0 | 6.503 | 0.309 | 25.934 |
| 27.0 | 6.774 | 0.114 | 26.033 |
| 27.0 | 6.991 | −0.129 | 26.157 |
| 27.0 | 7.137 | −0.410 | 26.300 |
| 27.0 | 7.194 | −0.716 | 26.456 |
| 27.0 | 7.122 | −1.432 | 26.821 |
| 27.0 | 6.990 | −2.142 | 27.183 |
| 27.0 | 6.831 | −2.848 | 27.542 |
| 27.0 | 6.647 | −3.549 | 27.899 |
| 27.0 | 6.419 | −4.239 | 28.251 |
| 27.0 | 6.286 | −4.463 | 28.365 |
| 27.0 | 6.097 | −4.653 | 28.462 |
| 27.0 | 5.866 | −4.800 | 28.537 |
| 27.0 | 5.607 | −4.906 | 28.591 |
| 27.0 | 5.331 | −4.968 | 28.623 |
| 27.0 | 4.268 | −5.048 | 28.663 |
| 27.0 | 3.201 | −5.090 | 28.684 |
| 27.0 | 2.134 | −5.120 | 28.700 |
| 27.0 | 1.067 | −5.142 | 28.711 |
| 27.0 | 0.000 | −5.152 | 28.716 |
| 27.0 | −1.067 | −5.142 | 28.711 |
| 27.0 | −2.134 | −5.120 | 28.700 |
| 27.0 | −3.201 | −5.090 | 28.684 |
| 27.0 | −4.268 | −5.048 | 28.663 |
| 27.0 | −5.331 | −4.968 | 28.623 |
| 27.0 | −5.607 | −4.906 | 28.591 |
| 27.0 | −5.866 | −4.800 | 28.537 |
| 27.0 | −6.097 | −4.653 | 28.462 |
| 27.0 | −6.286 | −4.463 | 28.365 |
| 27.0 | −6.419 | −4.239 | 28.251 |
| 27.0 | −6.647 | −3.549 | 27.899 |

TABLE 1-continued

| Theta (deg.) | X | Y | Z |
|---|---|---|---|
| 27.0 | −6.831 | −2.848 | 27.542 |
| 27.0 | −6.990 | −2.142 | 27.183 |
| 27.0 | −7.194 | −0.716 | 26.456 |
| 27.0 | −7.137 | −0.410 | 26.300 |
| 27.0 | −6.991 | −0.129 | 26.157 |
| 27.0 | −6.774 | 0.114 | 26.033 |
| 27.0 | −6.503 | 0.309 | 25.934 |
| 27.0 | −6.191 | 0.447 | 25.863 |
| 27.0 | −4.988 | 0.785 | 25.691 |
| 27.0 | −3.760 | 1.046 | 25.558 |
| 27.0 | −2.516 | 1.237 | 25.461 |
| 27.0 | −1.261 | 1.355 | 25.401 |
| 28.0 | 0.000 | 1.496 | 26.431 |
| 28.0 | 1.294 | 1.466 | 26.448 |
| 28.0 | 2.585 | 1.375 | 26.496 |
| 28.0 | 3.869 | 1.227 | 28.575 |
| 28.0 | 5.142 | 1.021 | 26.684 |
| 28.0 | 6.400 | 0.749 | 26.829 |
| 28.0 | 6.682 | 0.641 | 26.886 |
| 28.0 | 6.925 | 0.475 | 26.974 |
| 28.0 | 7.114 | 0.261 | 27.088 |
| 28.0 | 7.231 | 0.010 | 27.221 |
| 28.0 | 7.263 | −0.259 | 27.365 |
| 28.0 | 7.149 | −1.011 | 27.765 |
| 28.0 | 6.997 | −1.758 | 28.162 |
| 28.0 | 6.828 | −2.502 | 28.557 |
| 28.0 | 6.644 | −3.243 | 28.951 |
| 28.0 | 6.431 | −3.978 | 29.342 |
| 28.0 | 6.317 | −4.188 | 29.454 |
| 28.0 | 6.145 | −4.365 | 29.548 |
| 28.0 | 5.928 | −4.497 | 29.618 |
| 28.0 | 5.683 | −4.585 | 29.665 |
| 28.0 | 5.423 | −4.624 | 29.686 |
| 28.0 | 4.338 | −4.631 | 29.690 |
| 28.0 | 3.254 | −4.624 | 29.686 |
| 28.0 | 2.169 | −4.620 | 29.684 |
| 28.0 | 1.085 | −4.622 | 29.684 |
| 28.0 | 0.000 | −4.625 | 29.686 |
| 28.0 | −1.085 | −4.622 | 29.684 |
| 28.0 | −2.169 | −4.620 | 29.684 |
| 28.0 | −3.254 | −4.624 | 29.686 |
| 28.0 | −4.338 | −4.631 | 29.690 |
| 28.0 | −5.423 | −4.624 | 29.686 |
| 28.0 | −5.683 | −4.585 | 29.665 |
| 28.0 | −5.928 | −4.497 | 29.618 |
| 28.0 | −6.145 | −4.365 | 29.548 |
| 28.0 | −6.317 | −4.188 | 29.454 |
| 28.0 | −6.431 | −3.978 | 29.342 |
| 28.0 | −6.644 | −3.243 | 28.951 |
| 28.0 | −6.997 | −1.758 | 28.162 |
| 28.0 | −7.149 | −1.011 | 27.765 |
| 28.0 | −7.263 | −0.259 | 27.365 |
| 28.0 | −7.231 | 0.010 | 27.221 |
| 28.0 | −7.114 | 0.261 | 27.088 |
| 28.0 | −6.925 | 0.475 | 26.974 |
| 28.0 | −6.682 | 0.641 | 26.886 |
| 28.0 | −6.400 | 0.749 | 26.829 |
| 28.0 | −5.142 | 1.021 | 26.684 |
| 28.0 | −3.869 | 1.227 | 26.575 |
| 28.0 | −2.585 | 1.375 | 26.496 |
| 28.0 | −1.294 | 1.466 | 26.448 |
| 29.0 | 0.000 | 1.726 | 27.427 |
| 29.0 | 1.323 | 1.702 | 27.441 |
| 29.0 | 2.643 | 1.629 | 27.481 |
| 29.0 | 3.959 | 1.509 | 27.547 |
| 29.0 | 5.268 | 1.342 | 27.640 |
| 29.0 | 6.566 | 1.122 | 27.762 |
| 29.0 | 6.823 | 1.036 | 27.810 |
| 29.0 | 7.043 | 0.891 | 27.890 |
| 29.0 | 7.208 | 0.698 | 27.998 |
| 29.0 | 7.301 | 0.471 | 28.123 |
| 29.0 | 7.311 | 0.230 | 28.256 |
| 29.0 | 7.161 | −0.547 | 28.687 |
| 29.0 | 6.993 | −1.322 | 29.117 |
| 29.0 | 6.817 | −2.095 | 29.546 |
| 29.0 | 6.633 | −2.867 | 29.973 |
| 29.0 | 6.434 | −3.636 | 30.400 |

TABLE 1-continued

| Theta (deg.) | X | Y | Z |
|---|---|---|---|
| 29.0 | 6.337 | −3.836 | 30.511 |
| 29.0 | 6.178 | −4.004 | 30.604 |
| 29.0 | 5.973 | −4.127 | 30.672 |
| 29.0 | 5.738 | −4.200 | 30.712 |
| 29.0 | 5.490 | −4.219 | 30.723 |
| 29.0 | 4.394 | −4.159 | 30.690 |
| 29.0 | 3.296 | −4.105 | 30.660 |
| 29.0 | 2.198 | −4.069 | 30.639 |
| 29.0 | 1.099 | −4.049 | 30.629 |
| 29.0 | 0.000 | −4.044 | 30.626 |
| 29.0 | −1.099 | −4.049 | 30.629 |
| 29.0 | −2.198 | −4.069 | 30.639 |
| 29.0 | −3.296 | −4.105 | 30.660 |
| 29.0 | −4.394 | −4.159 | 30.690 |
| 29.0 | −5.490 | −4.219 | 30.723 |
| 29.0 | −5.738 | −4.200 | 30.712 |
| 29.0 | −5.973 | −4.127 | 30.672 |
| 29.0 | −6.178 | −4.004 | 30.604 |
| 29.0 | −6.337 | −3.836 | 30.511 |
| 29.0 | −6.633 | −2.867 | 29.973 |
| 29.0 | −6.817 | −2.095 | 29.546 |
| 29.0 | −6.993 | −1.322 | 29.117 |
| 29.0 | −7.161 | −0.547 | 28.687 |
| 29.0 | −7.311 | 0.230 | 28.256 |
| 29.0 | −7.301 | 0.471 | 28.123 |
| 29.0 | −7.208 | 0.698 | 27.998 |
| 29.0 | −7.043 | 0.891 | 27.890 |
| 29.0 | −6.823 | 1.036 | 27.810 |
| 29.0 | −6.566 | 1.122 | 27.762 |
| 29.0 | −5.268 | 1.342 | 27.640 |
| 29.0 | −3.959 | 1.509 | 27.547 |
| 29.0 | −2.643 | 1.629 | 27.481 |
| 29.0 | −1.323 | 1.702 | 27.441 |
| 30.0 | 0.000 | 2.073 | 28.367 |
| 30.0 | 1.342 | 2.052 | 28.379 |
| 30.0 | 2.683 | 1.990 | 28.415 |
| 30.0 | 4.020 | 1.887 | 28.474 |
| 30.0 | 5.352 | 1.743 | 28.558 |
| 30.0 | 6.678 | 1.557 | 28.665 |
| 30.0 | 6.918 | 1.484 | 28.707 |
| 30.0 | 7.121 | 1.352 | 28.784 |
| 30.0 | 7.268 | 1.172 | 28.887 |
| 30.0 | 7.343 | 0.962 | 29.009 |
| 30.0 | 7.339 | 0.741 | 29.136 |
| 30.0 | 7.165 | −0.050 | 29.593 |
| 30.0 | 6.986 | −0.840 | 30.049 |
| 30.0 | 6.804 | −1.630 | 30.505 |
| 30.0 | 6.621 | −2.419 | 30.961 |
| 30.0 | 6.433 | −3.208 | 31.416 |
| 30.0 | 6.347 | −3.403 | 31.529 |
| 30.0 | 6.199 | −3.566 | 31.623 |
| 30.0 | 6.001 | −3.684 | 31.691 |
| 30.0 | 5.772 | −3.747 | 31.728 |
| 30.0 | 5.532 | −3.751 | 31.730 |
| 30.0 | 4.431 | −3.632 | 31.661 |
| 30.0 | 3.326 | −3.538 | 31.607 |
| 30.0 | 2.219 | −3.471 | 31.568 |
| 30.0 | 1.110 | −3.431 | 31.545 |
| 30.0 | 0.000 | −3.418 | 31.538 |
| 30.0 | −1.110 | −3.431 | 31.545 |
| 30.0 | −2.219 | −3.471 | 31.568 |
| 30.0 | −3.326 | −3.538 | 31.607 |
| 30.0 | −4.431 | −3.632 | 31.661 |
| 30.0 | −5.532 | −3.751 | 31.730 |
| 30.0 | −5.772 | −3.747 | 31.728 |
| 30.0 | −6.001 | −3.684 | 31.691 |
| 30.0 | −6.347 | −3.403 | 31.529 |
| 30.0 | −6.433 | −3.208 | 31.416 |
| 30.0 | −6.621 | −2.419 | 30.961 |
| 30.0 | −6.804 | −1.630 | 30.505 |
| 30.0 | −6.986 | −0.840 | 30.049 |
| 30.0 | −7.165 | −0.050 | 29.593 |
| 30.0 | −7.339 | 0.741 | 29.136 |
| 30.0 | −7.343 | 0.962 | 29.009 |
| 30.0 | −7.268 | 1.172 | 28.887 |
| 30.0 | −7.121 | 1.352 | 28.784 |
| 30.0 | −6.918 | 1.484 | 28.707 |

TABLE 1-continued

| Theta (deg.) | X | Y | Z |
|---|---|---|---|
| 30.0 | −6.678 | 1.557 | 28.665 |
| 30.0 | −5.352 | 1.743 | 28.558 |
| 30.0 | −4.020 | 1.887 | 28.474 |
| 30.0 | −2.683 | 1.990 | 28.415 |
| 30.0 | −1.342 | 2.052 | 28.379 |
| 31.0 | 0.000 | 2.530 | 29.248 |
| 31.0 | 1.350 | 2.511 | 29.259 |
| 31.0 | 2.698 | 2.453 | 29.294 |
| 31.0 | 4.043 | 2.356 | 29.352 |
| 31.0 | 5.384 | 2.220 | 29.434 |
| 31.0 | 6.719 | 2.047 | 29.538 |
| 31.0 | 6.952 | 1.979 | 29.579 |
| 31.0 | 7.149 | 1.851 | 29.656 |
| 31.0 | 7.289 | 1.677 | 29.760 |
| 31.0 | 7.358 | 1.474 | 29.882 |
| 31.0 | 7.349 | 1.263 | 30.009 |
| 31.0 | 7.165 | 0.473 | 30.484 |
| 31.0 | 6.982 | −0.318 | 30.959 |
| 31.0 | 6.798 | −1.109 | 31.434 |
| 31.0 | 6.615 | −1.899 | 31.909 |
| 31.0 | 6.431 | −2.690 | 32.384 |
| 31.0 | 6.350 | −2.881 | 32.499 |
| 31.0 | 6.205 | −3.042 | 32.596 |
| 31.0 | 6.010 | −3.157 | 32.665 |
| 31.0 | 5.783 | −3.217 | 32.701 |
| 31.0 | 5.546 | −3.215 | 32.700 |
| 31.0 | 4.444 | −3.075 | 32.616 |
| 31.0 | 3.337 | −2.966 | 32.550 |
| 31.0 | 2.227 | −2.888 | 32.503 |
| 31.0 | 1.114 | −2.841 | 32.475 |
| 31.0 | 0.000 | −2.825 | 32.466 |
| 31.0 | −1.114 | −2.841 | 32.475 |
| 31.0 | −2.227 | −2.888 | 32.503 |
| 31.0 | −3.337 | −2.966 | 32.550 |
| 31.0 | −4.444 | −3.075 | 32.616 |
| 31.0 | −5.546 | −3.215 | 32.700 |
| 31.0 | −6.010 | −3.157 | 32.665 |
| 31.0 | −6.205 | −3.042 | 32.596 |
| 31.0 | −6.350 | −2.881 | 32.499 |
| 31.0 | −6.431 | −2.690 | 32.384 |
| 31.0 | −6.615 | −1.899 | 31.909 |
| 31.0 | −6.798 | −1.109 | 31.434 |
| 31.0 | −6.982 | −0.318 | 30.959 |
| 31.0 | −7.165 | 0.473 | 30.484 |
| 31.0 | −7.349 | 1.263 | 30.009 |
| 31.0 | −7.358 | 1.474 | 29.882 |
| 31.0 | −7.289 | 1.677 | 29.760 |
| 31.0 | −7.149 | 1.851 | 29.656 |
| 31.0 | −6.952 | 1.979 | 29.579 |
| 31.0 | −6.719 | 2.047 | 29.538 |
| 31.0 | −5.384 | 2.220 | 29.434 |
| 31.0 | −4.043 | 2.356 | 29.352 |
| 31.0 | −2.698 | 2.453 | 29.294 |
| 31.0 | −1.350 | 2.511 | 29.259 |

While the invention has been described in the preferred embodiment, it is to be understood that the invention is not to be limited to the disclosed embodiment but, on the contrary, is intended to cover various modifications and equivalent arrangements within the scope of the following claims.

What we claim is:

1. A transition duct having an inlet ring, an aft frame, and a panel assembly connecting said inlet ring to said aft frame, said panel assembly having an inlet end of generally circular cross section having a center and being connected to said inlet ring and having an outlet end of generally rectangular arc-like cross section connected to said aft frame, said panel assembly having an uncoated internal profile substantially in accordance with coordinate values X, Y, and Z at an angle θ, as set forth in Table 1, said X, Y, and Z values carried only to three decimal places wherein said coordinates are relative to an origin at the center of said inlet end and taken at a sweep angle θ that is measured from a first plane defined by said inlet end and increases toward a second plane defined by said outlet end, said planes intersecting at a line about which the angle θ is measured, and X, Y, and Z are coordinates defining the panel assembly profile at each angle θ from said inlet end, X, Y, and Z have an origin at the center of said inlet end, and the z-axis is perpendicular to said first plane.

2. A transition duct according to claim 1 wherein said panel assembly comprises an upper panel and lower panel, said upper panel and lower panel joined together along a plurality of axial seams by welding.

3. A transition duct according to claim 1 wherein manufacturing tolerances for said panel assembly internal profile are at least 0.062 inches.

4. A transition duct according to claim 1 wherein said transition duct panel assembly has a two-layer air plasma sprayed coating comprising a bond coating applied along said internal profile of said panel assembly and a top coating applied over said bond coating.

5. A transition duct according to claim 4 wherein said two layer coating applied along said internal profile is at least 0.019 inches thick.

6. A transition duct according to claim 1 wherein said transition duct contains a plurality of cooling holes in said panel assembly.

7. A transition duct according to claim 1 wherein said panel assembly is fabricated from a high temperature nickel base alloy.

8. A transition duct having an inlet ring, an aft frame, and a panel assembly connecting said inlet ring to said aft frame, said panel assembly having an inlet end of generally circular cross section having a center and being connected to said inlet ring and having an outlet end of generally rectangular arc-like cross section connected to said aft frame, said panel assembly having an uncoated internal profile within an envelope of +/−0.250 inches in a direction normal to any surface with coordinate values X, Y, and Z at an angle θ, as set forth in Table 1, said X, Y, and Z values carried only to three decimal places wherein said coordinates are relative to an origin at the center of said inlet end and taken at a sweep angle θ that is measured from a first plane defined by said inlet end and increases toward a second plane defined by said outlet end, said planes intersecting at a line about which the angle θ is measured, and X, Y, and Z are coordinates defining the panel assembly profile at each angle θ from said inlet end, X, Y, and Z have an origin at the center of said inlet end, and the z-axis is perpendicular to said first plane.

9. A transition duct according to claim 8 wherein said panel assembly comprises an upper panel and lower panel, said upper panel and lower panel joined together along a plurality of axial seams by welding.

10. A transition duct according to claim 8 wherein said transition duct panel assembly has a two-layer air plasma sprayed coating comprising a bond coating applied along said internal profile of said panel assembly and a top coating applied over said bond coating.

11. A transition duct according to claim 10 wherein said two-layer coating applied along said internal profile is at least 0.019 inches thick.

12. A transition duct according to claim 8 wherein said transition duct contains a plurality of cooling holes in said panel assembly.

13. A transition duct according to claim 8 wherein said panel assembly is fabricated from a high temperature nickel base alloy.

* * * * *